US010513863B1

(12) United States Patent
Deeb et al.

(10) Patent No.: US 10,513,863 B1
(45) Date of Patent: Dec. 24, 2019

(54) SWIMMING POOL COPING ARRANGEMENTS

(71) Applicant: Trojan Leisure Products, LLC, Albany, NY (US)

(72) Inventors: Stephen E. Deeb, Schenectady, NY (US); Collin J. Sirco, Ballston Lake, NY (US); Nicholas V. Filippelli, Loudonville, NY (US)

(73) Assignee: Trojan Leisure Products, LLC, Albany, NY (US)

( * ) Notice: Subject to any disclaimer, the term of this patent is extended or adjusted under 35 U.S.C. 154(b) by 0 days.

(21) Appl. No.: 16/188,676

(22) Filed: Nov. 13, 2018

Related U.S. Application Data

(60) Continuation of application No. 16/011,896, filed on Jun. 19, 2018, now Pat. No. 10,161,152, which is a division of application No. 15/355,545, filed on Nov. 18, 2016, now Pat. No. 10,006,215.

(51) Int. Cl.
*E04H 4/14* (2006.01)

(52) U.S. Cl.
CPC ..... *E04H 4/141* (2013.01); *E04H 2004/146* (2013.01)

(58) Field of Classification Search
CPC ..... E04H 4/141; E04H 2004/146; E04H 2004/147
See application file for complete search history.

(56) References Cited

U.S. PATENT DOCUMENTS

| | | | | |
|---|---|---|---|---|
| 3,335,429 | A | 8/1967 | Arp | |
| 3,351,958 | A | 11/1967 | Sheilds | |
| 3,427,663 | A | 2/1969 | O'Connell et al. | |
| 3,477,190 | A | 11/1969 | Wood | |
| 3,512,326 | A | 5/1970 | Greene | |
| 3,739,539 | A * | 6/1973 | Posnick | E04H 4/0043 52/169.8 |
| 3,777,318 | A | 12/1973 | Stillman | |
| 3,835,481 | A | 9/1974 | Engelhart et al. | |
| 3,839,748 | A | 10/1974 | Stillman, Jr. | |

(Continued)

OTHER PUBLICATIONS

"Metric Series Finishing Options" Brochure, Radiant Pools, 2pp. 2015.

(Continued)

*Primary Examiner* — Andrew J Triggs
(74) *Attorney, Agent, or Firm* — Tech Valley Patent, LLC; John Pietrangelo

(57) ABSTRACT

Coping arrangements and methods for mounting coping arrangements for swimming pools and related structures are provided. The coping arrangements include an elongated base member shaped and adapted to be received by a wall of a swimming pool; and a plurality of elongated top members, each of the plurality of elongated top members are adapted to be replaceably mounted to the elongated base member, and each of the plurality of elongated top members having an exposed contour different from each of the other elongated top members. The different exposed contours of the top members of the coping arrangement may comprise different cross-sectional. Methods for changing a coping arrangement, coping arrangement kits, coping members, and methods for installing a pool are also disclosed.

20 Claims, 17 Drawing Sheets

(56) References Cited

U.S. PATENT DOCUMENTS

| | | | | |
|---|---|---|---|---|
| 4,003,180 | A | 1/1977 | Messuri | |
| 4,120,126 | A * | 10/1978 | West | E04H 4/00 52/169.7 |
| 4,457,119 | A | 7/1984 | Dahowski | |
| 4,601,073 | A * | 7/1986 | Methot | E04H 4/142 4/506 |
| 4,901,492 | A | 2/1990 | Coates | |
| 5,170,517 | A | 12/1992 | Stegmeier | |
| 5,680,730 | A | 10/1997 | Epple | |
| 6,725,469 | B2 | 4/2004 | Coates | |
| 7,861,471 | B2 | 1/2011 | Smith | |
| 10,006,215 | B1 * | 6/2018 | Deeb | E04H 4/141 |
| 10,161,152 | B1 * | 12/2018 | Deeb | E04H 4/141 |
| 2003/0084619 | A1 | 5/2003 | Smith | |
| 2005/0091738 | A1 | 5/2005 | Smith | |
| 2008/0104745 | A1 | 5/2008 | Beudoin et al. | |
| 2010/0251474 | A1 | 10/2010 | Hempleman-Adams | |
| 2011/0061158 | A1 * | 3/2011 | Smith | E04H 4/101 4/506 |

OTHER PUBLICATIONS

"New Premium Coping Installation" Brochure, Radiant Pools, 2pp. 2015.

Office Action issued for parent utility U.S. Appl. No. 15/355,545, dated Jul. 28, 2017, 8 pp.

Office Action issued for parent utility U.S. Appl. No. 15/355,545, dated Feb. 23, 2018, 16 pp.

Office Action, Restriction, issued for parent utility U.S. Appl. No. 15/355,545, dated May 27, 2017, 6 pp.

Office Action, Restriction, issued for parent utility U.S. Appl. No. 16/011,896, dated Sep. 5, 2018, 5 pp.

* cited by examiner

SWIMMING POOL COPING ARRANGEMENTS

CROSS-REFERENCE TO RELATED APPLICATION

This application is a continuation application of U.S. patent application Ser. No. 16/011,896, filed on Jun. 19, 2018, now U.S. Pat. No. 10,161,152, which is a divisional application of and claims priority from U.S. patent application Ser. No. 15/355,545, filed on Nov. 18, 2016, now U.S. Pat. No. 10,006,215, the disclosures of which are included by reference herein in their entirety. This application is also related to pending U.S. Design patent application 29/650,203, filed on Jun. 5, 2018, the disclosures of which is included by reference herein in its entirety.

BACKGROUND OF THE INVENTION

Technical Field

The invention generally concerns swimming pool copings, that is, the attractive and protective covers mounted to the edges of swimming pools, and methods of mounting coping arrangements. In particular, the invention provides coping arrangements and methods that facilitate pool installation which permit the ready replacement of an installed coping having one appearance with a replacement coping having a different appearance, as desired.

Description of Related Art

The popularity of swimming pools, in particular, residential swimming pools, in the early 21$^{st}$ century has posed new concerns for swimming pool providers, installers, and owners. Economic and scheduling pressures to enhance the utility and aesthetic features of pools due to the demands of pool owners, while enhancing availability, reducing maintenance, and reducing cost have forced pool providers to substantially continuously improve their product and develop new products to meet the demands of the customer and to overcome the competition. As is typical of many industries, labor costs, or the time it takes the installer to properly install contemporary pool designs, is one such concern of the pool supplier and customer.

Specifically, the creative demands of the customer and site specific demands of an installation, often can increases the cost of pool installation, including for inground, semi-inground, and above-ground pools. Any improvements in installation efficiency or reductions in the time required or the ease with which a pool can be installed can improve the pool providers bottom line while, it is hoped, make the customer happy. Aspects of the present invention facilitate pool installation and can provide the pool owner with increased flexibility for changing pool appearance.

As is typical in the art, the inground or above-ground pool is typically integrated into an adjacent or adjoining "deck," for example, a concrete deck, a stone deck, or a wood/composite deck. Since the integration of the adjacent deck with the pool, typically provided with some form of "coping," can be critical to the appearance of the pool-deck installation and thus can be critical to the satisfaction of the customer, great pains are typically taken to provide an accurate installation of the integration of the pool with the deck.

Accordingly, the prior art contains many examples of pool copings that attempt to address this need. For example, U.S. Pat. Nos. 3,335,429; 3,477,190; 3,427,663; 3,512,326; 3,835,481; 3,839,748; 4,457,119; 5,170,517; and 6,725,469; and US Patent Publications 2003/0084619 and 2010/0251474 disclose attempts to improve the design and construction of pool copings. However, aspects of the present invention overcome the disadvantages of this and other prior art while providing improvements in installation efficiency and design flexibility.

SUMMARY OF THE INVENTION

Recognizing the limitations of the prior art, aspects of the present invention were conceived and developed to provide the pool installer and the pool owner with improved coping arrangements, improved methods for installing coping arrangements, and improved method for installing swimming pools, among other structures.

For example, according to one embodiment of the present invention, a swimming pool coping arrangement is provided. The coping arrangement comprises or includes: an elongated base member shaped and adapted to be received by a wall of a swimming pool; and a plurality of elongated top members, each of the plurality of elongated top members adapted to be replaceably mounted to the elongated base member, and each of the plurality of elongated top members having an exposed contour different from each of the other elongated top members. In one aspect, the exposed contour different from each of the other elongated top members comprises a profile different from each of the other elongated top members. In another aspect, the exposed contour different from each of the other elongated top members comprises a cross section different from each of the other elongated top members.

In one aspect, the exposed contour different from each of the other elongated top members comprises a substantially horizontal top portion and a lateral portion different from a lateral portion of each of the other elongated top members. For example, in one aspect, the lateral portion of the elongated top members different from the lateral portion of each of the other elongated top members comprises a curvilinear projection, for instance, a radiused projection.

Another embodiment of the invention is a method for changing a coping of a swimming pool wall, the method comprising or including: removing a first elongated top member having a first exposed contour from an elongated base member mounted to a wall of a swimming pool to expose the elongated base member; and mounting a second elongated top member having a second exposed contour different from the first exposed contour to the elongated base member. In one aspect, the removing the first elongated top member comprises flexibly disengaging the first elongated top member from the elongated base member, for example, flexibly disengaging a projection from a recess.

In one aspect, mounting the second elongated top member to the elongated base member may be practiced by flexibly engaging the second elongated top member with the elongated base member, for example, flexibly engaging a projection with a recess.

In one aspect, the method for changing the coping is practiced without removing a pool liner from the coping or from the pool. In another aspect, the method for changing the coping is practiced without removing water from the pool.

A further embedment of the invention is a coping arrangement kit comprising or including: an elongated base member shaped and adapted to be received by a wall of a swimming pool; and a plurality of elongated top members, each of the plurality of elongated top members adapted to be replaceably mounted to the elongated base member, and each of the plurality of elongated top members having an exposed contour different from each of the other elongated top members. In one aspect, the kit may further include installation instructions, such as, a brochure or a digital medium.

A still further embodiment of the invention is a method for installing a swimming pool, the method comprising or including: erecting a plurality of pool panels to form at least a partial support structure for a swimming pool; mounting a base member of a coping arrangement to an upper extremity of at least one of the plurality of pool panels; installing backfill outside a periphery of at least some of the pool panels; and mounting a top member of the coping arrangement to the base member to form the coping of the swimming pool. In one aspect, installing backfill is practiced to provide a level of backfill at an elevation lower than an elevation of a lower extremity of the base member. In another aspect, the method may further include installing further backfill to provide a level of backfill at an elevation higher than the elevation of the lower extremity of the base member.

These and other aspects, features, and advantages of this invention will become apparent from the following detailed description of the various aspects of the invention taken in conjunction with the accompanying drawings

BRIEF DESCRIPTION OF THE DRAWINGS

The subject matter, which is regarded as the invention, is particularly pointed out and distinctly claimed in the claims at the conclusion of the specification. The foregoing and other objects, features, and advantages of the invention will be readily understood from the following detailed description of aspects of the invention taken in conjunction with the accompanying drawings in which:

DETAILED DESCRIPTION OF THE INVENTION

Aspects of the present invention address the limitations of the prior art by providing coping arrangements and methods of mounting coping to a pool wall that include an elongated base member and an assortment of elongated top members adapted to be engaged and disengaged from the base member. The elongated base member may typically be an elongated extruded aluminum base member having projections positioned and adapted to engage recesses in the top members. The elongated top members may typically be elongated plastic extrusions having recesses positioned and adapted to receive the projections of the base member.

Figure 1:
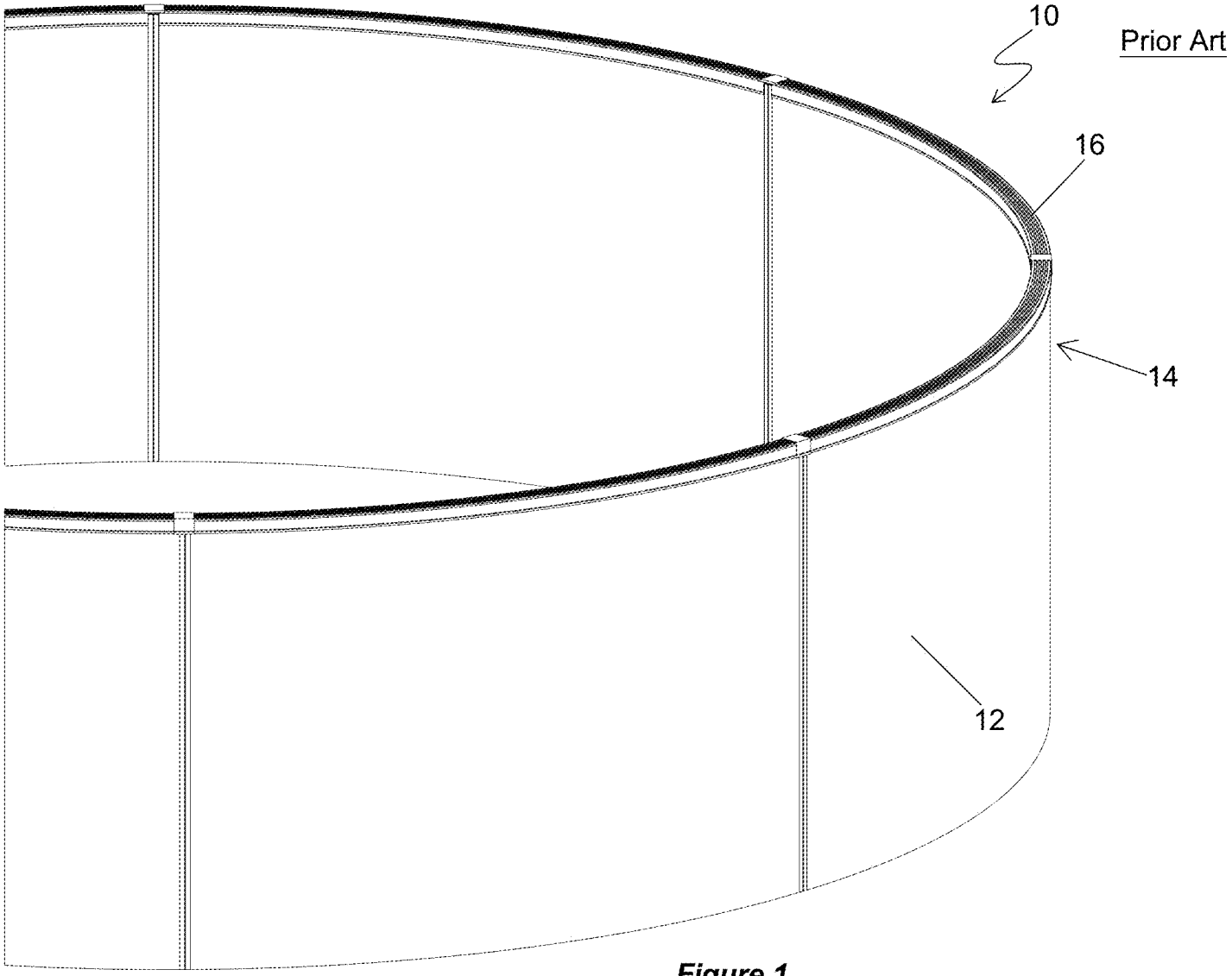
FIG. 1 is a perspective view of a prior art swimming pool having a coping about its upper rim according to the prior art.

FIG. 1 is a perspective view of a prior art swimming pool 10 having a sidewall 12 having an upper rim 14 to which aspects of the present invention may be applied. As is typical in the prior art, to protect and conceal the upper rim 14 and to protect bathers and others from contact with the upper rim 14, a coping or coping arrangement 16 conceals the upper rim 14. As is typical, coping arrangement 16 mounts to rim 14 and, among other things, conceals the upper rim 14 and provides a uniform, more aesthetically pleasing appearance to the pool 10.

Figure 3:
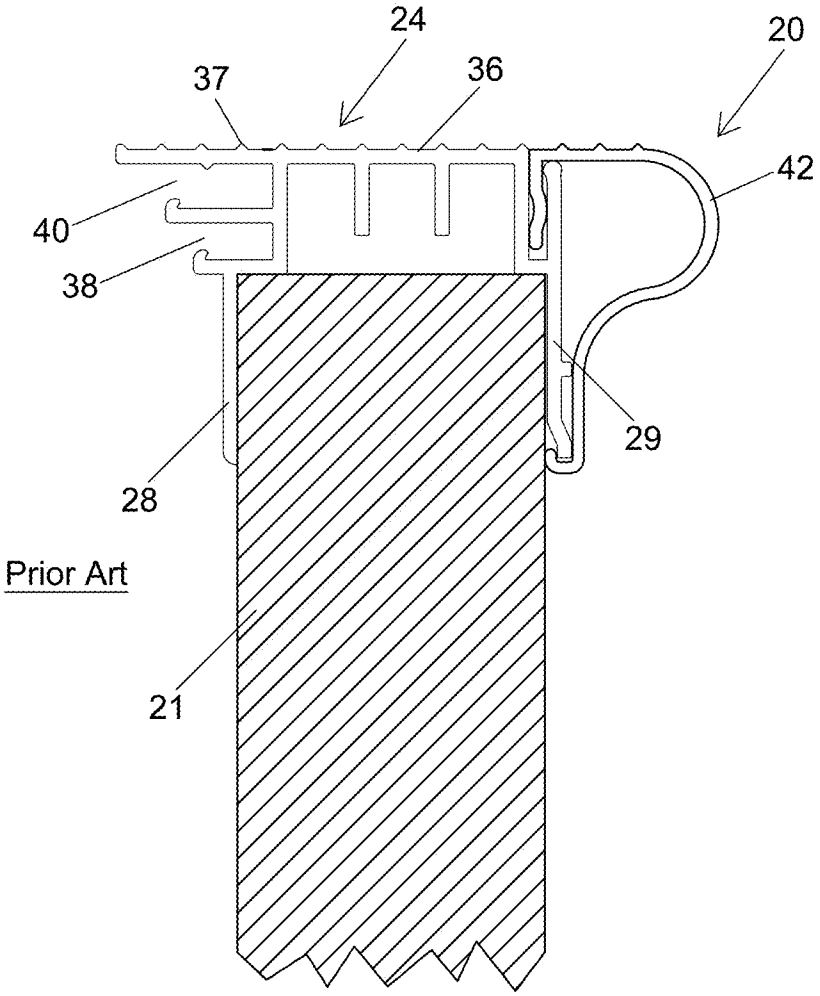
Prior Art Figure 3
FIG. 3 is a side elevation view, partially in cross section, of another coping arrangement according the prior art.
Figure 2:
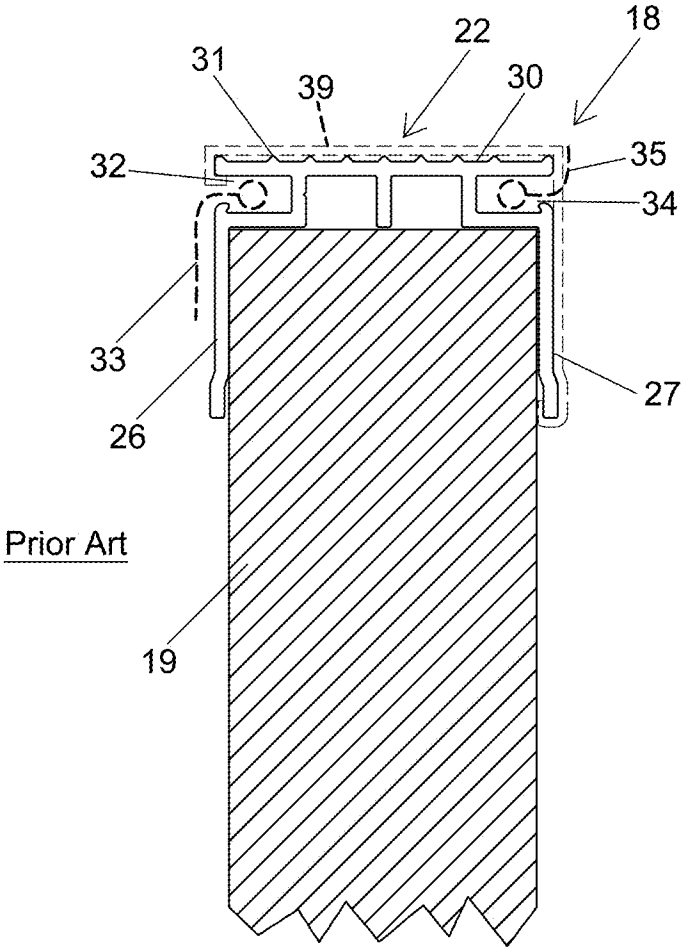
Prior Art Figure 2
FIG. 2 is a side elevation view, partially in cross section, of a coping arrangement according to the prior art.

FIGS. 2 and 3 are side elevation views, partially in cross section, of two coping arrangements 18 and 20, respectively, according to the prior art. As shown in FIGS. 2 and 3, prior art coping arrangement 18 and 20 are typically mounted to a sidewall 19 and 21, respectively, of a pool, for example, with mechanical fasteners (not shown). Prior art coping arrangements 18 and 20 typically each comprise an elongated, typically extruded plastic (for example, polyvinylchloride [PVC] plastic) coping pieces 22 and 24, respectively, having opposing flanges 26, 27 and 28, 29, respectively, that engage the top of sidewall 19 or 21, respectively. As shown in FIG. 2, coping piece 22 typically includes a top surface 30 having ridges or projections 31 intended to minimize or prevent slipping by a bather, a recess 32 positioned and adapted to receive and retain a pool internal liner 33, and a recess 34 positioned and adapted to receive and retain a pool cover 35, for example, a protective cover shielding the pool from inclement weather, and the like. As shown in FIG. 2, coping arrangement 18 may include a plurality of coping gap covers or "clips" 39 (shown in phantom) adapted to cover gaps between adjacent coping pieces 22. Similarly, as shown in FIG. 3, coping piece 24 typically includes a top surface 36 having ridges or projections 37 intended to minimize or prevent slipping by the bather, a recess 38 positioned and adapted to receive and retain a pool internal liner (not shown), and a recess 40 positioned and adapted to receive and retain a pool cover (not shown). As also shown in FIG. 3, for the coping arrangement 20, extrusion 24 may be adapted to receive a finish piece 42, for example, a "bullnose" exterior finish piece, adapted to further enhance the atheistic appearance of the pool. Further coping arrangements are disclosed, for example, in the pamphlet "Metric Series Finishing Options," provided by Radiant Pools of Albany, N.Y., the disclosure of which is included by reference herein.

Though coping arrangements 18 and 20, and other similar prior art coping arrangements, have proven to be effective in providing the desired concealment and protection of the upper rims of pool sidewalls, and appropriate attachment points for liners and covers, these and other prior art coping arrangements have yielded challenges to the pool installer and to the pool owner. For example, for the pool owner, once a coping arrangement 18 or 20 is installed, little or no possibility of varying the appearance of the coping arrangement, short of total removal or reconstruction of the coping, is typically foreseeable. That is, once the coping arrangement is installed, the owner is deterred from changing the appearance of the coping arrangement without undesirable expense. For the pool installer, the prior art coping arrangements represented by coping arrangements 18 and 20 can interfere with the installation process by, among other things, requiring that the coping arrangement be defined and physically installed before adjacent preparation can proceed. For example, as known in the art, when installing an in-ground or semi-inground pool, coping arrangements, such as arrangements 18 and 20, typically require that the coping be installed prior to the preparation and installation of adjacent surfaces, for example, any wood decking, concrete decking, or patio block be installed. For instance, when using prior art coping arrangements, such as, arrangement 18 or 20, when the desired coping design is not yet established, for example, not decided upon by the pool customer, the installer cannot complete the installation of the adjacent, for example, concrete deck. Though possibly not a consequence to the customer, such an interruption in the installation procedure can dramatically interfere with the installer's installation procedures and schedule. As discussed below, aspects of the present invention overcome these and other disadvantages of the prior art.

Figure 4:
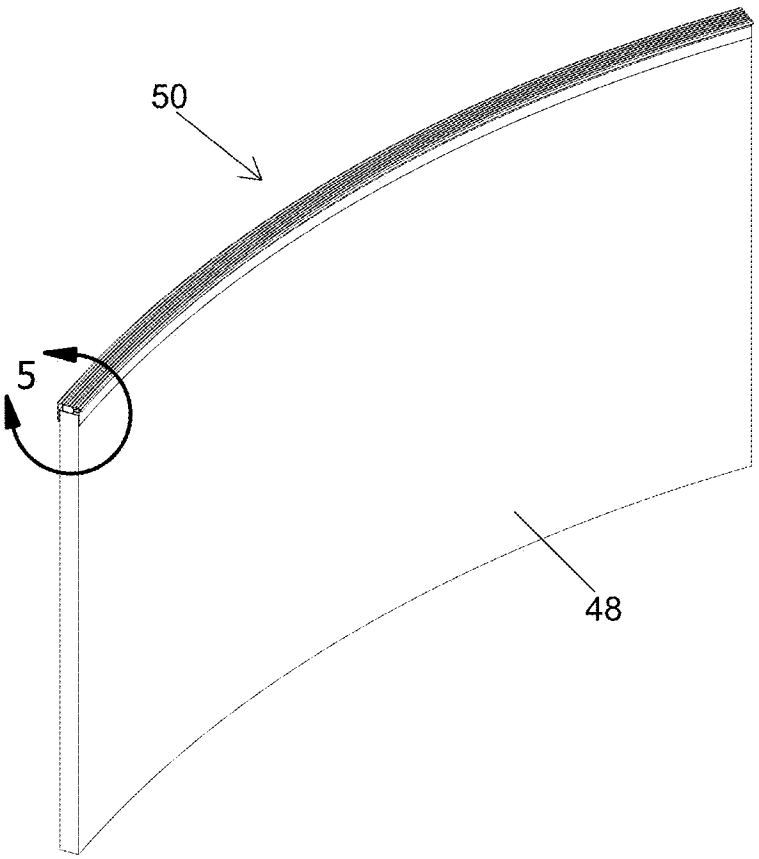
FIG. 4 is a perspective view of a pool panel having a coping arrangement according to one aspect of the present invention.
Figure 5:
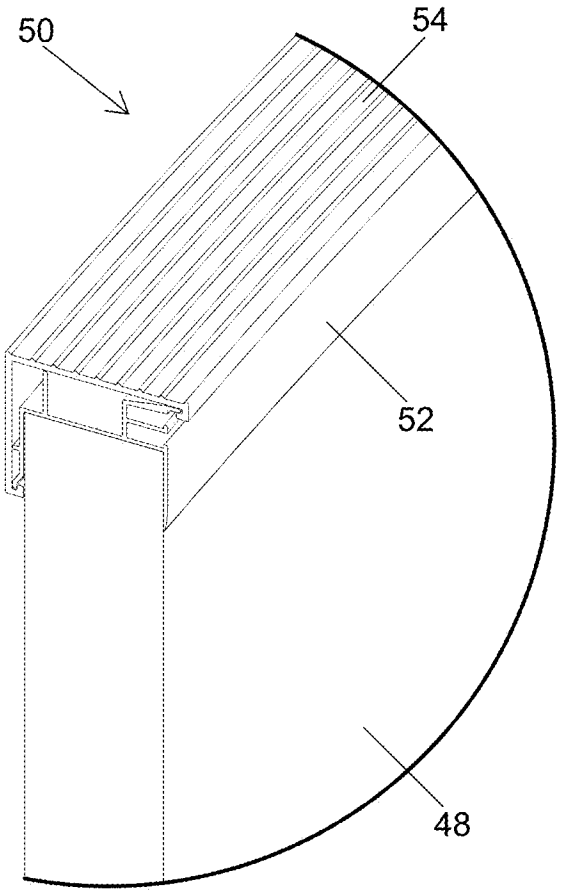
FIG. 5 is a detailed perspective view of the coping arrangement shown FIG. 4, as identified by Detail 5 in FIG. 4.

FIG. 4 is a perspective view of a pool panel 48 having a coping arrangement 50 according to one aspect of the present invention. FIG. 5 is a detailed perspective view of the coping arrangement 50 shown FIG. 4, as identified by Detail 5 in FIG. 4. Pool panel 48 may typically be one of a series of panels arranged to form a pool enclosure, for example, an enclosure receiving a pool liner (that is, the "vinyl" liner as known in the art). According to aspects of the invention, pool panel 48 may be any typical pool panel, wall, or barrier constructions known in the art. In one aspect, pool panel 48 may be a pool panel provided by Radiant Pools of Albany, N.Y., or their equivalent. For instance, pool panel 48 may be similar or substantially identical to the insulated pool panels disclosed in U.S. Patent Publication 2008/0104745 of Beaudoin, et al., which is incorporated by reference herein.

Figure 6:
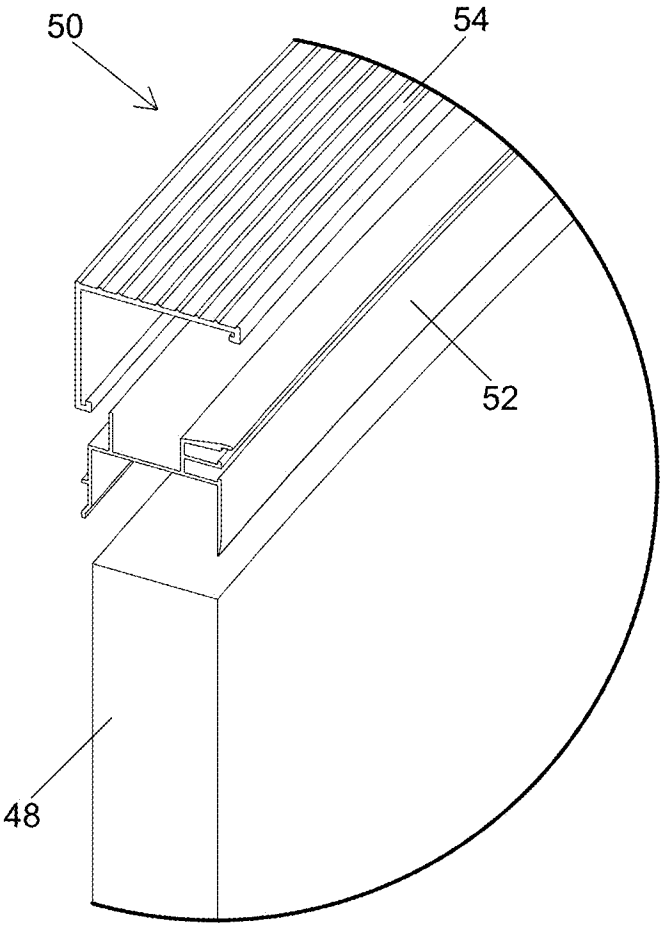
FIG. 6 is an exploded perspective view of the detail shown in FIG. 5.

FIG. 6 is an exploded perspective view of the detail shown in FIG. 5. As shown in FIGS. 5 and 6, coping arrangement 50 includes a set of elongated members, or elongated base member 52 and elongated top member 54, where base member 52 mounts to the top of pool panel 48 and top member 54 engages base member 52. As shown most clearly in FIGS. 4 and 5, elongated members 52 and 54 may be elongated, arcuate or curved members conforming to the elongation and/or radius of pool panel 48. In one aspect, pool panel 48 and members 52 and 54 may be radiused, for example, concave or convex, or unradiused, for example, substantially straight or linearly elongated. In one aspect, curvature or elongation of members 52 and 54 may vary, for example, consistent with the variation of the curvature of panel 48.

Figure 8:
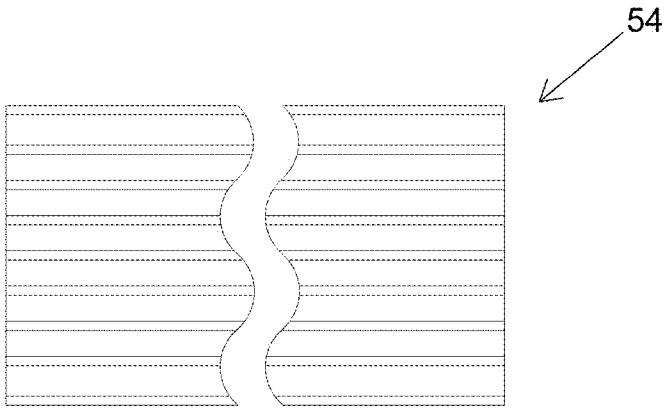
FIG. 8 is a top plan view of the elongated top member shown in FIG. 7.
Figure 10:
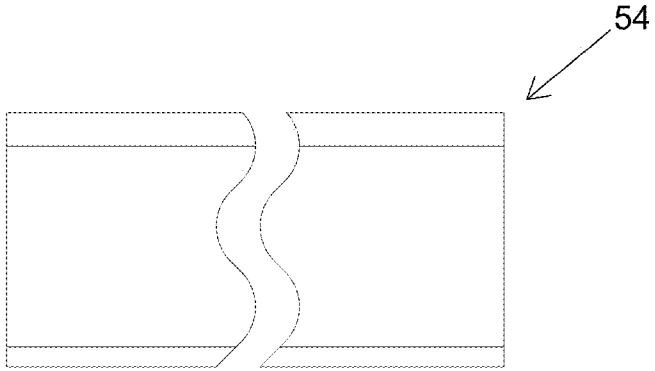
FIG. 10 is a right-side elevation view of the elongated top member shown in FIG. 7.
Figure 7:
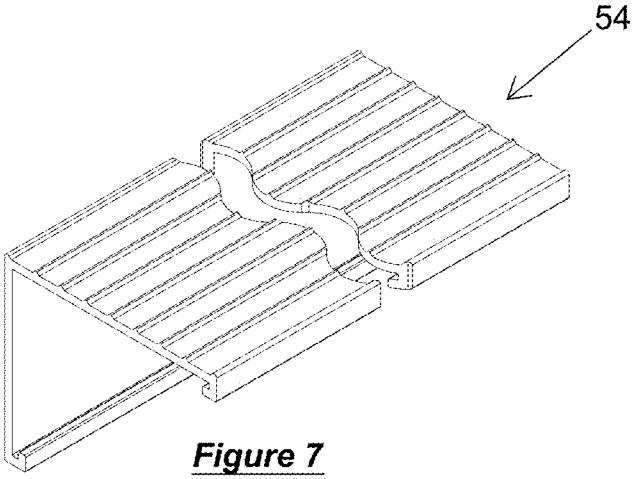
FIG. 7 is a perspective view of the elongated top member of the coping arrangement shown in FIG. 6.
Figure 9:
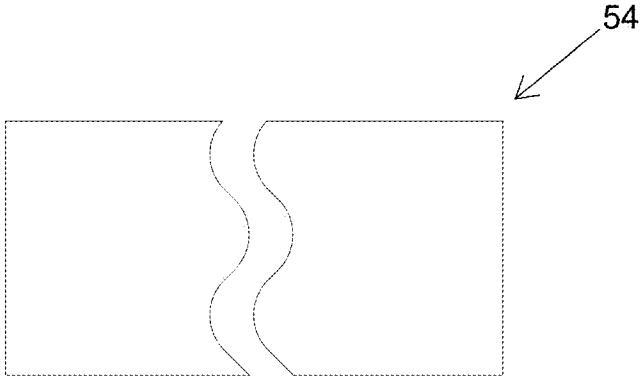
FIG. 9 is a left-side elevation view of the elongated top member shown in FIG. 7.

FIG. 7 is a perspective view of the elongated top member 54 of the coping arrangement 50 shown in FIG. 6. FIG. 8 is a top plan view of elongated top member 54 shown in FIG. 7. FIG. 9 is a left-side elevation view of elongated top member 54 shown in FIG. 7, and FIG. 10 is a right-side elevation view of elongated top member 54 shown in FIG. 7. The line breaks shown in FIGS. 7 through 10 indicate that, according to one aspect, elongated top member 54 may be of indeterminate length.

Figure 12:
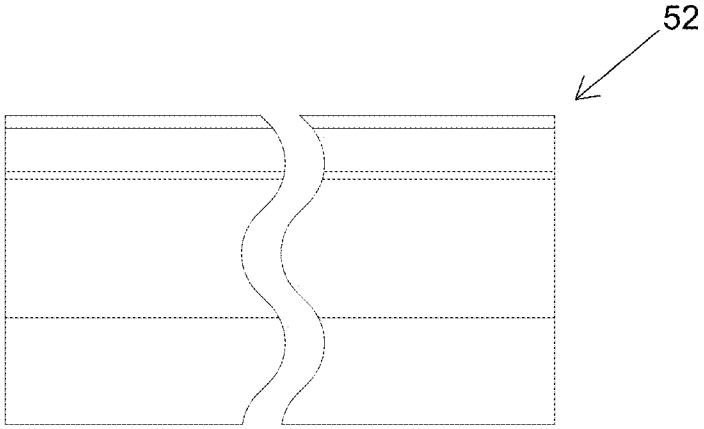
FIG. 12 is a top plan view of the elongated base member shown in FIG. 11.
Figure 14:
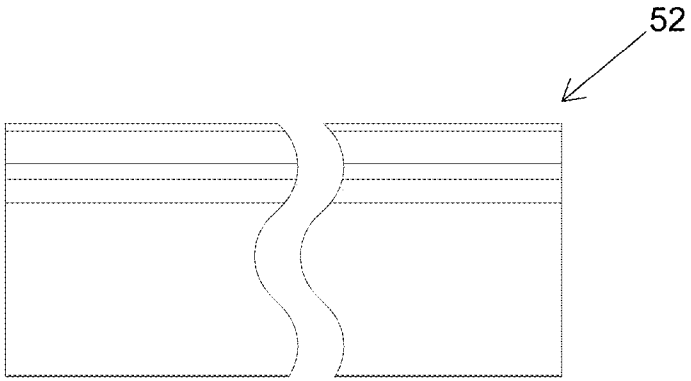
FIG. 14 is a right-side elevation view of the elongated base member shown in FIG. 11.
Figure 11:
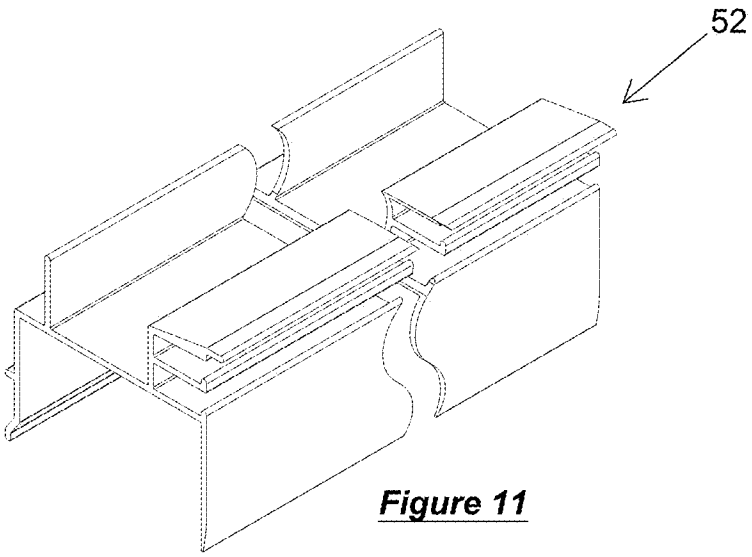
FIG. 11 is a perspective view of the elongated base member of the coping arrangement shown in FIG. 6.
Figure 13:
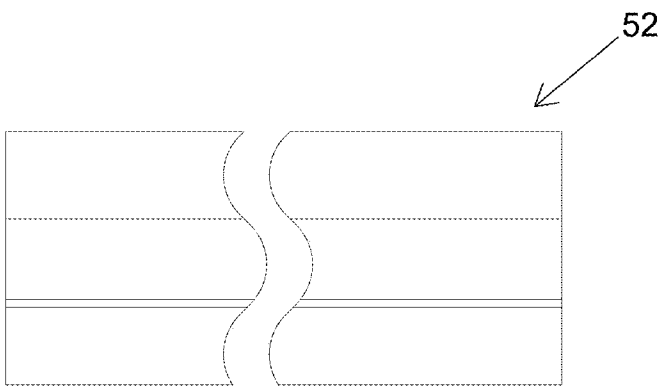
FIG. 13 is a left-side elevation view of the elongated base member shown in FIG. 11.

FIG. 11 is a perspective view of the elongated base member 52 of the coping arrangement 50 shown in FIG. 6. FIG. 12 is a top plan view of elongated base member 52 shown in FIG. 11. FIG. 13 is a left-side elevation view of elongated base member 52 shown in FIG. 11, and FIG. 14 is a right-side elevation view of elongated base member 52 shown in FIG. 11. The line breaks shown in FIGS. 11 through 14 indicate that, according to one aspect, elongated base member 52 may be of indeterminate length.

Figure 16:
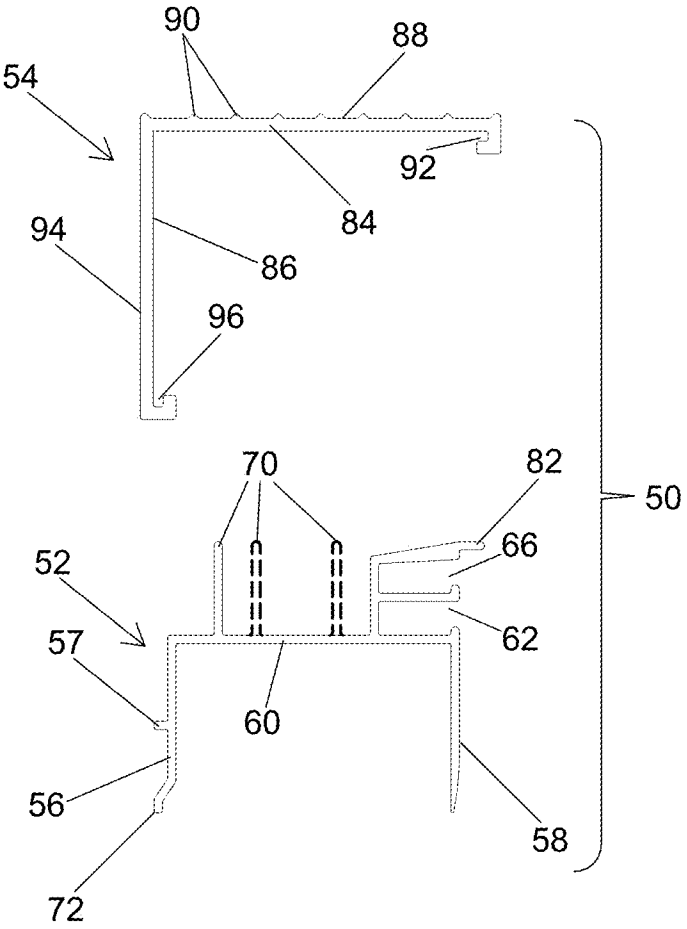
FIG. 16 is an exploded side elevation view of the coping arrangement shown in FIG. 15.
Figure 15:
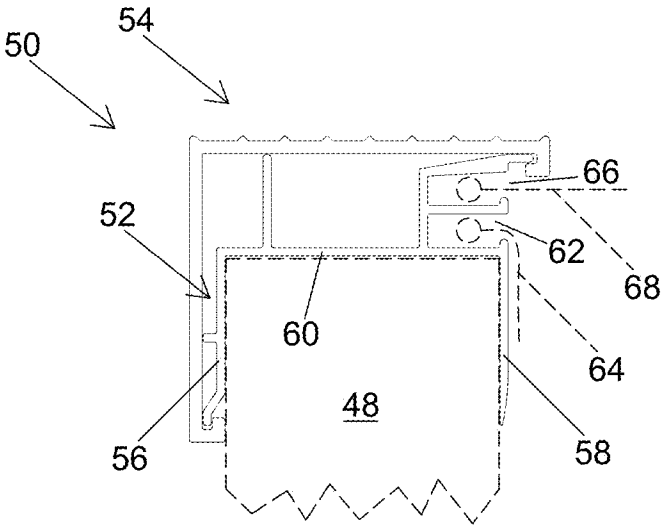
FIG. 15 is a side elevation view of the coping arrangement shown in FIG. 7.

FIG. 15 is a side elevation view of the coping arrangement 50 shown in FIG. 6 having base member 52 shown in FIGS. 11 through 14 and top member 54 shown in FIGS. 7 through 10. FIG. 16 is an exploded side elevation view of the coping arrangement 50 shown in FIG. 7. As shown in FIGS. 15 and 16, in this aspect, elongated base member 52, for example, an aluminum extrusion, may typically have elongated opposing extensions, sides, or flanges 56 and 58 mounted to a main panel or plate 60. Opposing flanges 56 and 58 engage the top of sidewall 48 (shown in phantom in FIG. 15). The mounting of base member 52 to sidewall 48 may include the use of one or more mechanical fasteners (not shown), for example, screws inserted through flange 56, flange 58, and/or plate 60. In one aspect, one or more plates 60 may be provided, for example, two or plates 60 each separated by a cavity or void. Flanges 56 and 58 may include one or more elongated ribs 57, for example, strength reinforcing ribs, as needed. Base member 52 may include one or more a recesses 62 positioned and adapted to receive and retain a pool internal liner 64 (shown in phantom) and/or one or more recess 66 positioned and adapted to receive and retain a pool cover 68 (shown in phantom), for example, a protective winter cover, or the like. However, in other aspects, recesses 62 or 66 may be omitted without detracting from the advantages of aspects of the invention.

As indicated by the structures shown in FIGS. 4 through 16, base member 52 and top member 54, and any base member or top member disclosed herein, may typically comprise elongated members having an indeterminate length, for example, having longitudinal length ranging from about 6 inches to about 24 feet, but typically, ranging from about 3 feet to about 12 feet. If not already apparent, according to aspects of the invention, each base member or top member disclosed herein may typically have a substantially uniform transverse cross-section, for example, a uniquely shaped cross section along the length of each member. However, it is envisioned that the uniform cross section may, for some reason, vary along a portion of the length without distracting from the function or advantages of aspects of the invention. Also, any base member or top member disclosed herein, may typically have a width or height ranging from about 1 inch to about 2 feet, but typically, ranging from about 2 inches to about 4 inches.

As shown most clearly in FIG. 16, base member 52 may include one or more elongated ribs 70 (one rib 70 shown in phantom), for example, substantially upstanding, vertical ribs, mounted to plate 60. In one aspect, base member 52 may include 2 or more ribs 70, of uniform or varying length. In one aspect, ribs 70 may be excluded without detracting from the advantages of aspects of the invention. As shown in FIG. 15, one or more ribs 70 may contact and support top member 54 (or any top member disclosed herein).

In one aspect, base member 52 (and any base member disclosed herein) may comprise a channel or conduit 71, for example, a channel or conduit defined by the one or more ribs 70 in base member 52. The channel 71 may be directed in the direction of elongation of base member 52. In one aspect, channel 71 may provide a passage for electrical wires or cables, for example, for illumination (that is, lighting), powering of pool equipment, powering of adjacent equipment, or for illumination of coping arrangement 50 (or any coping arrangement disclosed herein). In one aspect, base member 52 (and any base member disclosed herein) and/or top member 54 (and any top member disclosed herein) may be made of a light transmitting material, for example, a translucent or a transparent material, such as, a translucent or a transparent plastic, where any light source positioned, for example, in channel 71, may be visible through the base member and/or the top member. The light sources that may be positioned in coping arrangement 50 (or any coping arrangement disclosed herein) may include fluorescent lights, incandescent lights, and light-emitting diodes (LEDs), among other conventional light sources.

According to aspects of the invention, base member 52 typically includes at least one, but preferably, at least two projections positioned, sized, and otherwise adapted to engage top member 54 (or any top member disclosed herein). As shown in FIG. 16, in this aspect, base member 52 includes a projection 72, that is, an elongated projection, from flange 56 that is adapted to engage a cavity or recess 96 in top member 54. In the aspect of the invention shown in FIGS. 15 and 16, projection 72 comprises a deviation or rise from the general plane of flange 56; however, according to aspects of the invention, projection 72 may comprise any structural feature adapted to engage and retain top member 54. For example, projection 72 may comprise rib 57, for example, a rib 57 defining a recess or cavity into which cavity or recess 96 of top member 54 may engage. In another aspect, projection 72 may comprise a projection from plate 60, from a rib 70, or from the structures defining recess 62 or 66. For example, projection 72 may comprise a substantially horizontal projection from rib 70 or an oblique projection from plate 60 positioned and adapted to engage cavity or recess 96 of top member 54. Other constructions adapted to engage cavity or recess 96 with base member 52 will be apparent to those of skill in the art.

Similarly, in the aspect of the invention shown in FIG. 16, base member 52 (and any base member disclosed herein) may include a projection 82, that is, an elongated projection, from the structure defining recess 66 that is adapted to engage a cavity or recess 92 in top member 54 (or any top member disclosed herein). In the aspect of the invention shown in FIGS. 15 and 16, projection 82 comprises a horizontal projection from the upper wall defining the top of recess 66; however, according to aspects of the invention, projection 82 may comprise any structural feature adapted to engage and retain top member 54. For example, projection 82 may comprise a rib or projection (not shown) on flange 58, for example, a rib similar to rib 57 on flange 56; a projection from any surface defining the extremities of recesses 62 and/or 66 into which cavity or recess 92 of top member 54 may engage. In another aspect, projection 82 may comprise a projection from plate 60 or from a rib 70, for example, a substantially horizontal projection from rib 70 or an oblique projection from plate 60 positioned and adapted to engage cavity or recess 92 of top member 54. Other constructions adapted to engage cavity or recess 92 with base member 52 will be apparent to those of skill in the art. In one aspect, top member 54 (and any top member disclosed herein) may be mounted to base member 52 without the use of mechanical fasteners.

As also shown in FIGS. 15 and 16, in this aspect, elongated top member 54, for example, a PVC plastic extrusion, may typically having elongated top portion 84 and an elongated side portion 86 mounted to top portion 84. According to this aspect, top portion 84 may typically include a top surface 88 having ridges or projections 90 adapted, for example, to minimize or prevent slipping by a bather. In one aspect, ridges 90 may be omitted. According to this aspect, top portion 84 of top member 54 includes at least one recess 92, for example, at least one elongated recess, adapted to engage a projection on base member 52, for example, projection 82 on base member 52. Similarly, side portion 86 of top member 54 may include a side surface 94 having ridges or projections adapted, for example, to minimize or prevent slipping by a bather. In one aspect, as shown in FIGS. 15 and 16, ridges may be omitted from the surface 94. According to this aspect, side portion 86 of top member 54 includes at least one recess 92, for example, at least one elongated recess, adapted to engage a projection on base member 52, for example, projection 82 on base member 52.

In the aspect shown in FIGS. 15 and 16, though projection 72 of base member 52 engages recess 96 of top member 54 and projection 82 of base member 52 engages recess 92 of top member 54, it is envisioned that base member 52 may include one or more recesses (not shown) that are adapted to engage one or more complementarily sized and positioned projections (not shown) on top member 54.

According to aspects of the invention, though any convenient procedure may be used to engage top member 54 with base member 52, in is envisioned that, after base member 52 us mounted to pool panel 48, the coping installer may typically first engage elongated recess 92 with elongated projection 82, and then rotate top member 54 in a counter clockwise direction (as viewed in FIGS. 15 and 16) to engage recess 96 with projection 72. However, it is also envisioned that the installer may first engage elongated recess 72 with elongated projection 96, and then rotate top member 54 in a clockwise direction (as viewed in FIGS. 15 and 16) to engage recess 92 with projection 82.

It is envisioned that engagement of projection 82 with recess 92 and/or the engagement of projection 72 with recess 96 may comprise some form of deflection of the projection and/or of the recess, for example, some form of elastic deflection. For example, in one aspect, a pressure or force may be applied by an installer to a portion of top member 54 or to a portion of base member 52 to elastically deflect a projection or recess to overcome a structural interference and engage a projection with a recess. In one aspect, the engagement of a projection with a recess may comprise a "snap in" engagement. The engagement of the top member 54 (and any top member disclosed herein) with base member 52 may typically be practiced manually, though a tool or automated procedure may be used.

As discussed above, base member 52 and top member 54 may be fabricated as extrusions, for example, base member 52 may comprise an extruded aluminum alloy, and top member 54 may comprise an extruded PVC plastic. However, base member 52 and top member 54 may be fabricated from two or more piece parts and, for example, assembled with an adhesive, with welding, or with mechanical fasteners.

In addition to aluminum or an aluminum alloy (for example, aluminum alloy 6063 T-4, or its equivalent), base member 52 and top member 54 may be fabricated from any structural metal, such as, steel, stainless steel, nickel, or titanium. Also, in addition to PVC plastic, base member 52 and top member 54 may be fabricated from any convenient plastic, for example, a polyamide (PA), for example, nylon; a polyethylene (PE), both high-density polyethylene (HDPE) and low-density polyethylene (LDPE); a polyethylene terephthalate (PET); a polypropylene (PP); a polyester (PE); a polytetrafluoroethylene (PTFE); a polystyrene (PS); an acrylonitrile butadiene styrene (ABS); of a polycarbonate (PC); among other plastics. In one aspect, top member 54 may be fabricated from an elastomeric or rubber material, for example, a natural polymer, such as, polyisoprene rubber, or a synthetic polymer, such as, a neoprene, a thermoplastic elastomer, a thermoplastic rubber, and a polyvinyl chloride, or an ethylene propylene diene monomer (EPDM) rubber, or the like.

Figure 18:
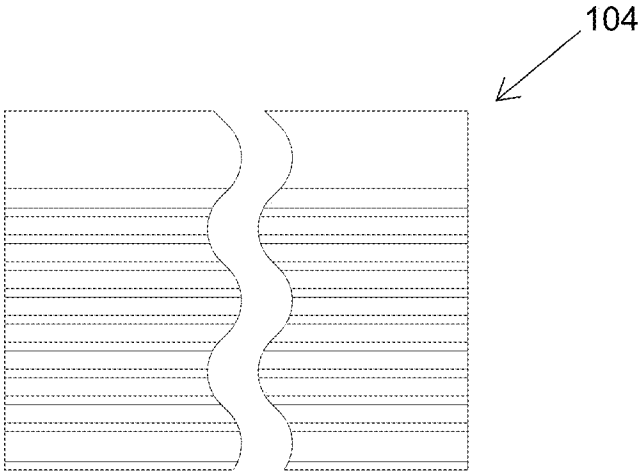
FIG. 18 is a top plan view of the elongated top member shown in FIG. 17.
Figure 20:
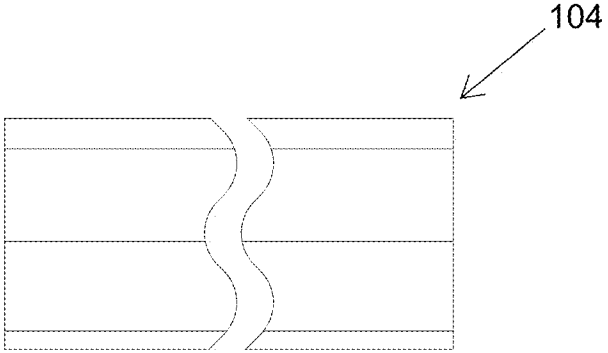
FIG. 20 is a right-side elevation view of the elongated top member shown in FIG. 17.
Figure 17:
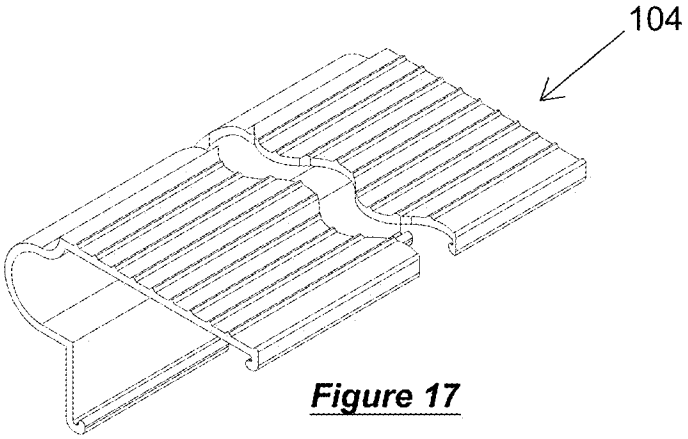
FIG. 17 is a perspective view of another elongated top member according to another aspect of the invention.
Figure 19:
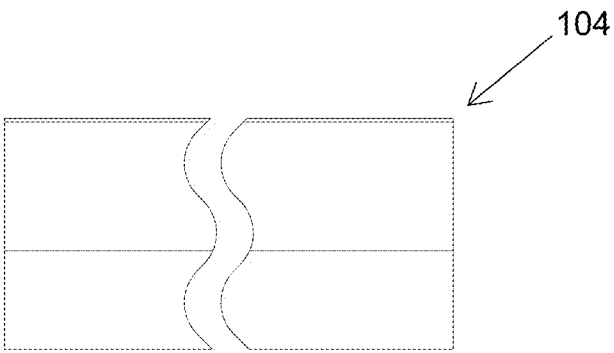
FIG. 19 is a left-side elevation view of the elongated top member shown in FIG. 17.

FIG. 17 is a perspective view of another coping arrangement elongated top member 104 according to another aspect of the invention. FIG. 18 is a top plan view of elongated top member 104 shown in FIG. 17. FIG. 19 is a left-side elevation view of elongated top member shown in FIG. 17, and FIG. 20 is a right-side elevation view of elongated top member 104 shown in FIG. 17. The line breaks shown in FIGS. 17 through 20 indicate that, according to one aspect, elongated top member 104 may be of indeterminate length.

As shown in FIGS. 17 through 20, and as will be elaborated upon below, according to aspects of the invention, elongated top member 104 (and other top members disclosed herein) comprises an exposed contour different from the exposed contours of other elongated top members disclosed herein, for example, different from the exposed contour of top member 54 shown in FIGS. 7 through 10. For example, a comparison of the contours of top member 104 with top member 54 reveals that, while top member 54 comprises a substantially planar surface 94 of side portion 86, top member 104 shown in FIGS. 17 through 20 comprises a bulbous or protruding side portion. In another aspect, the differences in the exposed contours of aspects of the invention may comprise differences in shape, differences in profile, and/or differences in cross-sections, for example, difference in axial cross sections, between top members disclosed herein.

Figure 22:
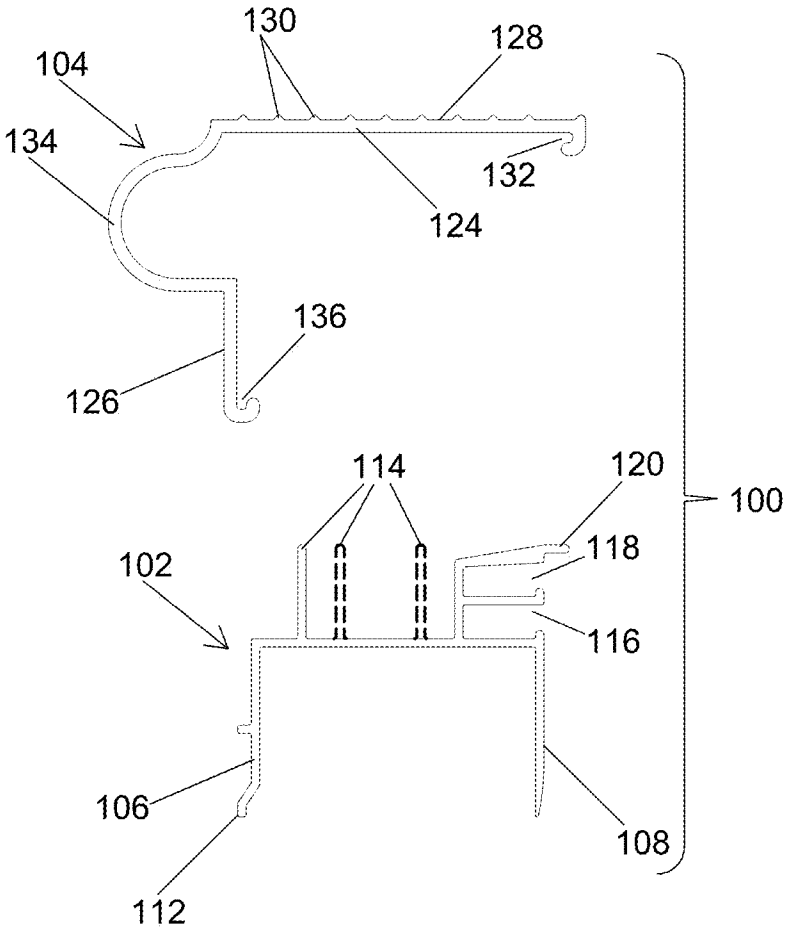
FIG. 22 is an exploded side elevation view of the coping arrangement shown in FIG. 21.
Figure 21:
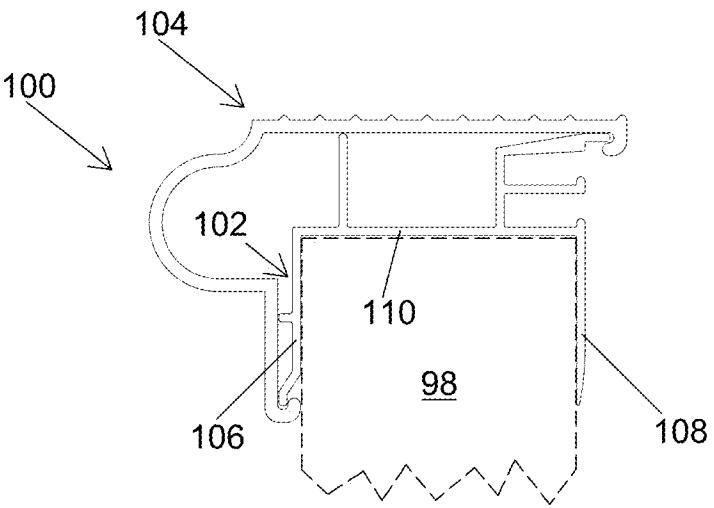
FIG. 21 is a side elevation view of a coping arrangement having the top member shown in FIGS. 17 through 20 according to another aspect of the invention.

FIG. 21 is a side elevation view of a coping arrangement 100 having top member 104 shown in FIGS. 17 through 20 according to another aspect of the invention. FIG. 22 is an exploded side elevation view of the coping arrangement 100 shown in FIG. 21. As shown in FIGS. 21 and 22, though shown in profile, coping arrangement 100 includes an elongated base member 102 and elongated top member 104 similar in design, construction, and function to elongated base member 52 and elongated top member 54 disclosed above. Specifically, base member 102 mounts to the top of pool panel 98 (shown in phantom in FIG. 21) and top member 104 engages base member 102. As is typical of members 52 and 54 shown in FIGS. 4 through 16, elongated members 102 and 104 may be elongated, arcuate or curved members conforming to the elongation and/or radius of pool panel 98. In one aspect, pool panel 98 and members 102 and 104 may be radiused, for example, concave or convex, or unradiused, for example, substantially straight or linearly elongated. In one aspect, the curvature or elongation of members 102 and 104 may vary, for example, consistent with the variation of the curvature of panel 98.

As shown in FIGS. 21 and 22, in this aspect, elongated base member 102 may have all the attributes, design, construction, and function of base member 52 disclosed in FIGS. 5 through 18. For example, base member 102 may be an extrusion of any one or more of the materials disclosed herein and may have elongated opposing flanges 106 and 108 mounted to a main panel or plate 110, and opposing flanges 106 and 108 engage the top of sidewall 98 (shown in phantom in FIG. 21). The mounting of base member 102 to sidewall 98 may include the use of one or more mechanical fasteners (not shown), for example, screws inserted through flange 106, flange 108, and/or plate 110. Flange 106 may typically have at least one projection 112 and plate 110 may typically have one or more ribs 114, one or more cavities 116, 118, and at least one projection 120. In addition, in a fashion similar to base member 52, base member 102 may be adapted to engage top member 104 as shown and described with respect to the engagement of top member 54 with base member 52 disclosed and described with respect to FIGS. 4 through 16. In one aspect, base member 102 may be substantially identical to base member 52. Accordingly, in one aspect, the principal distinction between coping arrangement 50 shown in FIGS. 4 through 16 and coping arrangement 100 shown in FIGS. 21 and 22 is the shape of top member 104.

As shown in FIGS. 21 and 22, elongated top member 104, for example, a PVC plastic extrusion, may typically have an elongated top portion 124 and an elongated side portion 126 mounted to top portion 124. According to this aspect, top portion 124 may typically include a top surface 128 having ridges or projections 130 adapted, for example, to minimize or prevent slipping by a bather. In one aspect, ridges 130 may be omitted. According to this aspect, top portion 124 of top member 104 includes at least one recess 132, for example, at least one elongated recess, adapted to engage a projection on base member 102, for example, projection 120 on base member 102.

In the aspect, shown in FIGS. 21 and 22, side portion 126 of top member 104 may include a projection or protuberance or "bull nose" 134, that is, an elongated protuberance, providing a smooth, continuous, aesthetically pleasing appearance to top member 104. Protuberance 134 may typically be hollow, though a substantially solid or non-hollow protuberance 134 may be provided. In one aspect, a hollow protuberance 134 (or any hollow protuberance disclosed herein) may provide a passage for electrical wires or cables, for example, for illumination of protuberance 134 or of light sources mounted to protuberance 134, among other lighting or electrical components that may be provided. In one aspect, the internal passage within protuberance 134 may provide a passage for electrical wires or cables, for example, for illumination (that is, lighting), powering of pool equipment, powering of adjacent equipment, or for illumination of coping arrangement 100 (or any coping arrangement disclosed herein). In one aspect, top member 104 (and any top member disclosed herein) and/or base member 102 (and any base member disclosed herein) may be made of a light transmitting material, for example, a translucent or a transparent material, such as, a translucent or a transparent plastic, where any light source positioned, for example, within protuberance 134 may be visible through the surface of protuberance 134. The light sources that may be positioned in coping arrangement 100 (or any coping arrangement disclosed herein) may include fluorescent lights, incandescent lights, and light-emitting diodes (LEDs), among other conventional light sources.

Though many smooth-surfaced protuberances 134 may be provided, for example, semicircular (as shown), or arcuate, or oval, among others, protuberance 134 may also be planar or angular, for example, triangular, square, rectangular or hexagonal, among other shapes. The surface of protuberance 134 may have ridges or projections adapted, for example, to minimize or prevent slipping by a bather. In one aspect, as shown in FIGS. 21 and 22, ridges may be omitted from the surface of protuberance 134. According to this aspect, side portion 126 of top member 104 includes at least one recess 136, for example, at least one elongated recess, adapted to engage a projection on base member 102, for example, projection 112 on base member 102.

As noted previously, in the aspect shown in FIGS. 21 and 22, though projection 112 of base member 102 engages recess 136 of top member 104 and projection 120 of base member 102 engages recess 132 of top member 104, it is envisioned that base member 102 may include one or more recesses (not shown) that are adapted to engage one or more complementarily sized and positioned projections (not shown) on top member 104.

As discussed above, base member 102 and top member 104 may be fabricated as extrusions, for example, base member 102 may comprise an extruded aluminum alloy, and top member 54 may comprise an extruded PVC plastic. However, base member 102 and top member 104 may be fabricated from two or more piece parts and, for example, assembled with adhesive, with welding, or with mechanical fasteners.

Figure 24:
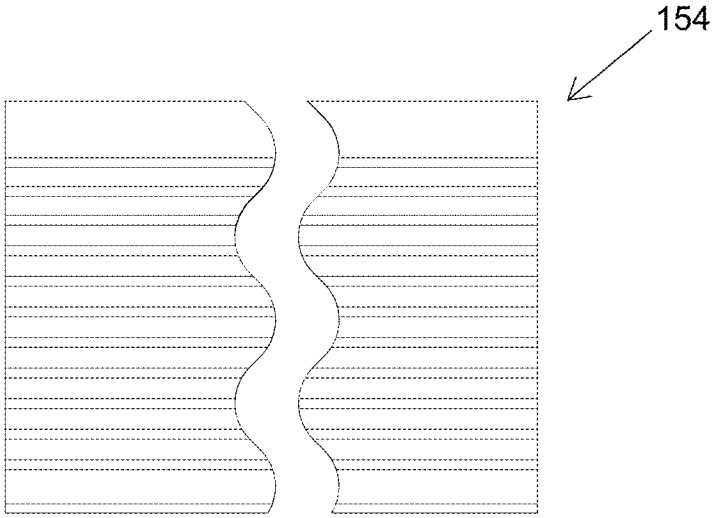
FIG. 24 is a top plan view of the elongated top member shown in FIG. 23.
Figure 26:
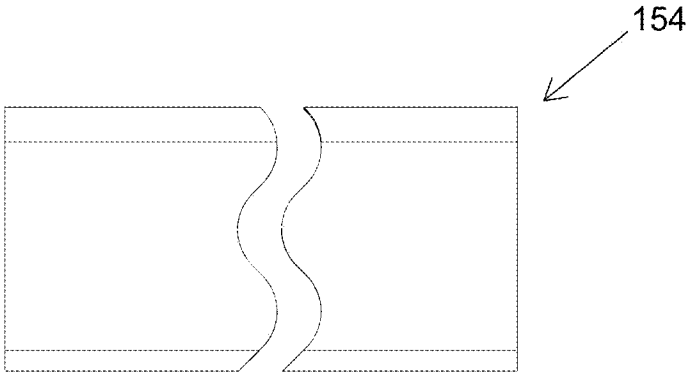
FIG. 26 is a right-side elevation view of the elongated top member shown in FIG. 23.
Figure 23:
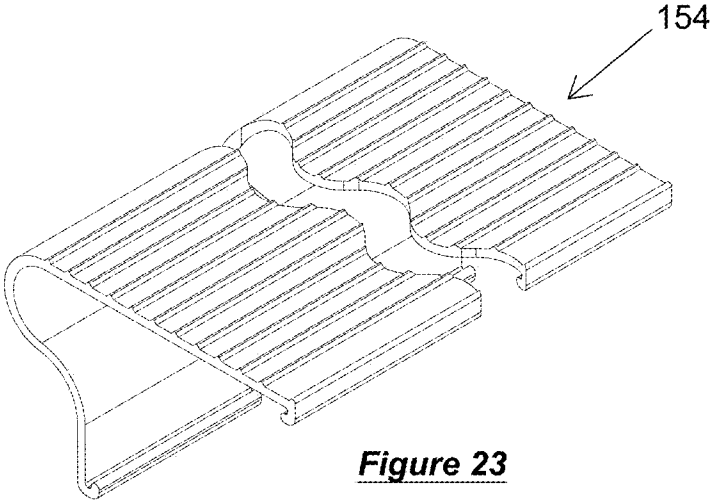
FIG. 23 is a perspective view of another elongated top member according to another aspect of the invention.
Figure 25:
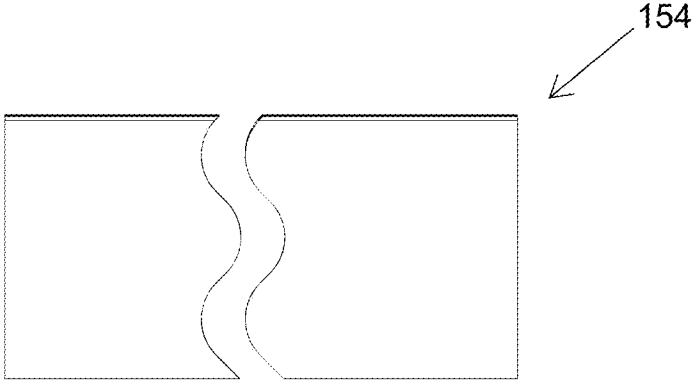
FIG. 25 is a left-side elevation view of the elongated top member shown in FIG. 23.

FIG. 23 is a perspective view of another elongated top member 154 according to another aspect of the invention. FIG. 24 is a top plan view of elongated top member 154 shown in FIG. 23. FIG. 25 is a left-side elevation view of elongated top member 154 shown in FIG. 23, and FIG. 26 is a right-side elevation view of elongated top member 154 shown in FIG. 23. The line breaks shown in FIGS. 23 through 26 indicate that, according to one aspect, elongated top member 154 may be of indeterminate length.

Figure 28:
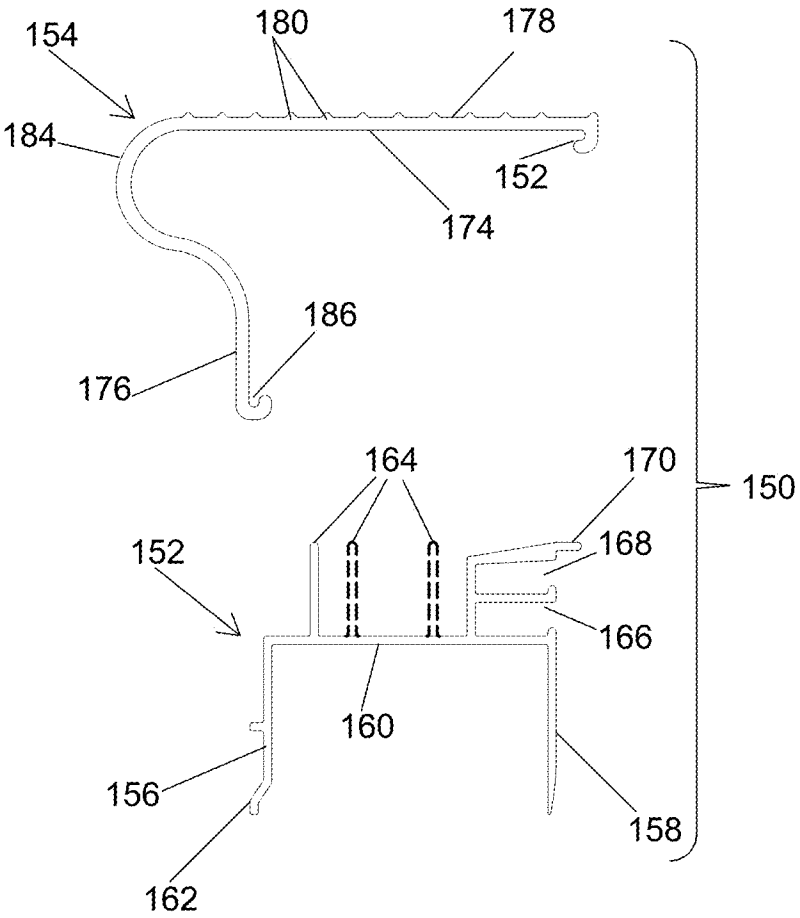
FIG. 28 is an exploded side elevation view of the coping arrangement shown in FIG. 27.
Figure 27:
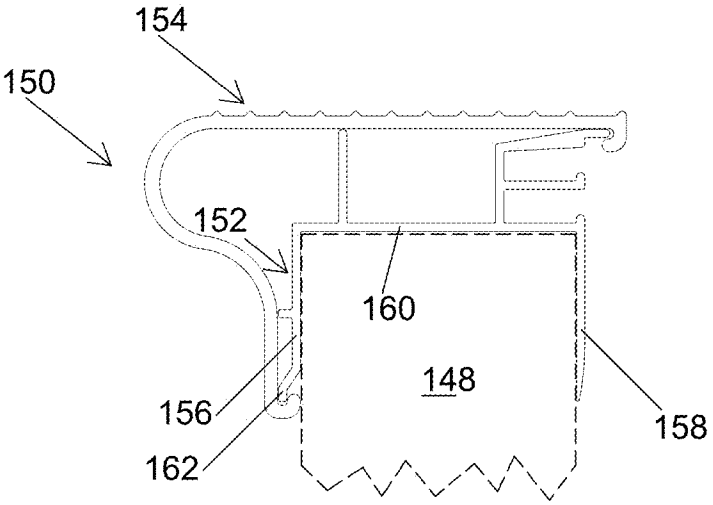
FIG. 27 is a side elevation view of another coping arrangement having the top member shown in FIGS. 23 through 26 according to another aspect of the invention.

FIG. 27 is a side elevation view of another coping arrangement 150 having top member 154 shown in FIGS. 23 through 26 according to another aspect of the invention. FIG. 28 is an exploded side elevation view of the coping arrangement 150 shown in FIG. 27. As shown in FIGS. 27 and 28, though shown in profile, coping arrangement 150 includes an elongated base member 152 and an elongated top member 154 similar in design, construction, and function to elongated base members 52 and 102 and elongated top members 54 and 104 disclosed above. Specifically, base member 152 mounts to the top of pool panel 148 (shown in phantom in FIG. 27) and top member 154 engages base member 152. As is typical of members 52, 102 and 54, 104, elongated members 152 and 154 may be elongated, arcuate or curved members conforming to the elongation and/or radius of pool panel 148. In one aspect, pool panel 148 and members 152 and 154 may be radiused, for example, concave or convex, or unradiused, for example, substantially straight or linearly elongated. In one aspect, the curvature or elongation of members 152 and 154 may vary, for example, consistent with the variation of the curvature of panel 148.

As shown in FIGS. 27 and 28, in this aspect, elongated base member 152 may have all the attributes, design, construction, and function of base member 52 disclosed in FIGS. 4 through 16. For example, base member 152 may be an extrusion of any one or more of the materials disclosed herein and have elongated opposing flanges 156 and 158 mounted to a main panel or plate 160 and opposing flanges 156 and 158 engage the top of sidewall 148 (shown in phantom in FIG. 27). The mounting of base member 152 to sidewall 148 may include the use of one or more mechanical fasteners (not shown), for example, screws inserted through flange 156, flange 158, and/or plate 160. Flange 156 may typically have at least one projection 162 and plate 160 may typically have one or more ribs 164 one or more cavities 166, 168, and at least one projection 170. In addition, in a fashion similar to base member 52, base member 152 may be adapted to engage top member 154 as shown and described with respect to the engagement of top member 54 with base member 52 as disclosed and described with respect to FIGS. 4 through 16. In one aspect, base member 152 may be substantially identical to base member 52. Accordingly, in one aspect, the principal distinction between coping arrangement 50 shown in FIGS. 5 through 8 and coping arrangement 150 shown in FIGS. 27 and 28 is the shape of top member 154.

As shown in FIGS. 27 and 28, elongated top member 154, for example, a PVC plastic extrusion, may typically have an elongated top portion 174 and an elongated side portion 176 mounted to top portion 124. According to this aspect, top portion 154 may typically include a top surface 178 having ridges or projections 180 adapted, for example, to minimize or prevent slipping by a bather. In one aspect, ridges 180 may be omitted. According to this aspect, top portion 174 of top member 154 includes at least one recess 182, for example, at least one elongated recess, adapted to engage a projection on base member 152, for example, projection 170 on base member 152.

In the aspect shown in FIGS. 27 and 28, side portion 176 of top member 154 may include a projection or protuberance or "bull nose" 184, that is, an elongated protuberance—different in shape from the protuberance 134 shown in FIGS. 17 through 22, providing a smooth, continuous, aesthetically pleasing appearance to top member 154. Protuberance 184 may typically be hollow, though a substantially solid or non-hollow protuberance 184 may be provided. In one aspect, a hollow protuberance 184 may provide a passage for electrical wires or cables, for example, for illumination of protuberance 184 or of light sources mounted to protuberance 184, among other electrical components that may be provided. Though many smooth-surfaced protuberances 184 may be provided, for example, semicircular (as shown), or arcuate, or oval, among others, protuberance 184 may also be planar or angular, for example, triangular, square, rectangular or hexagonal, among other shapes. The surface of protuberance 184 may have ridges or projections adapted, for example, to minimize or prevent slipping by a bather. In one aspect, as shown in FIGS. 27 and 28, ridges may be omitted from the surface of protuberance 184. According to this aspect, side portion 176 of top member 154 includes at least one recess 186, for example, at least one elongated recess, adapted to engage a projection on base member 152, for example, projection 162 on base member 152.

As noted previously, in the aspect shown in FIGS. 27 and 28, though projection 162 of base member 152 engages recess 186 of top member 154 and projection 170 of base member 152 engages recess 182 of top member 154, it is envisioned that base member 152 may include one or more recesses (not shown) that are adapted to engage one or more complementarily sized and positioned projections (not shown) on top member 154.

As discussed above, base member 152 and top member 154 may be fabricated as extrusions, for example, base member 152 may comprise an extruded aluminum and top member 154 may comprise an extruded PVC plastic. However, base member 152 and top member 154 may be fabricated from two or more piece parts and, for example, assembled with an adhesive, with welding, or with mechanical fasteners.

Figure 30:
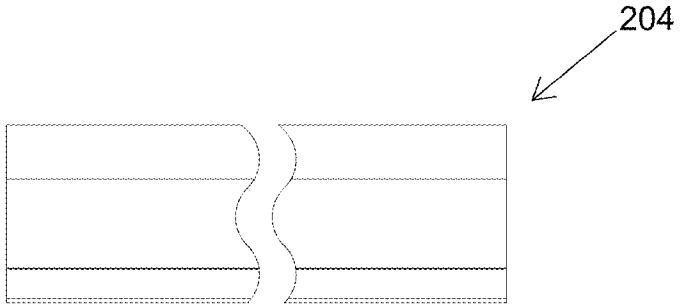
FIG. 30 is a top plan view of the elongated top member shown in FIG. 29.
Figure 32:
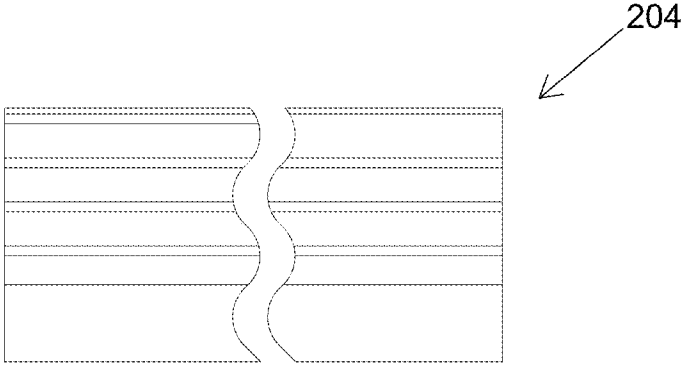
FIG. 32 is a right-side elevation view of the elongated top member shown in FIG. 29.
Figure 29:
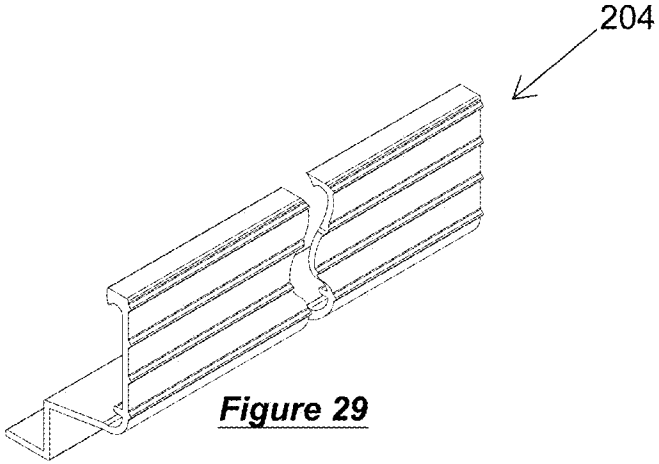
FIG. 29 is a perspective view of a further elongated top member according to a further aspect of the invention.
Figure 31:
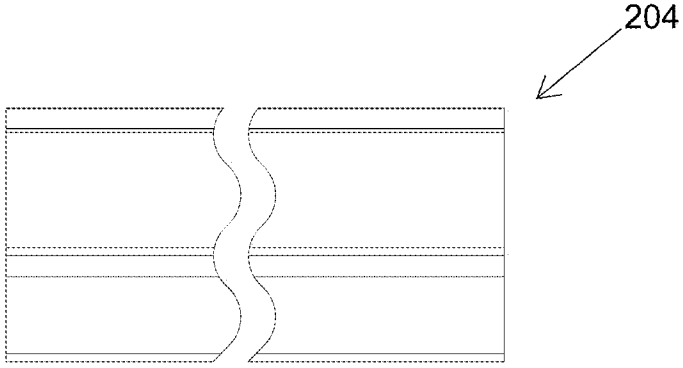
FIG. 31 is a left-side elevation view of the elongated top member shown in FIG. 29.

FIG. 29 is a perspective view of a further elongated top member 204 according to a further aspect of the invention. FIG. 30 is a top plan view of elongated top member 204 shown in FIG. 29. FIG. 31 is a left-side elevation view of elongated top member 204 shown in FIG. 29, and FIG. 32 is a right-side elevation view of the elongated top member shown in FIG. 29. The line breaks shown in FIGS. 29 through 32 indicate that, according to one aspect, elongated top member 204 may be of indeterminate length.

Figure 34:
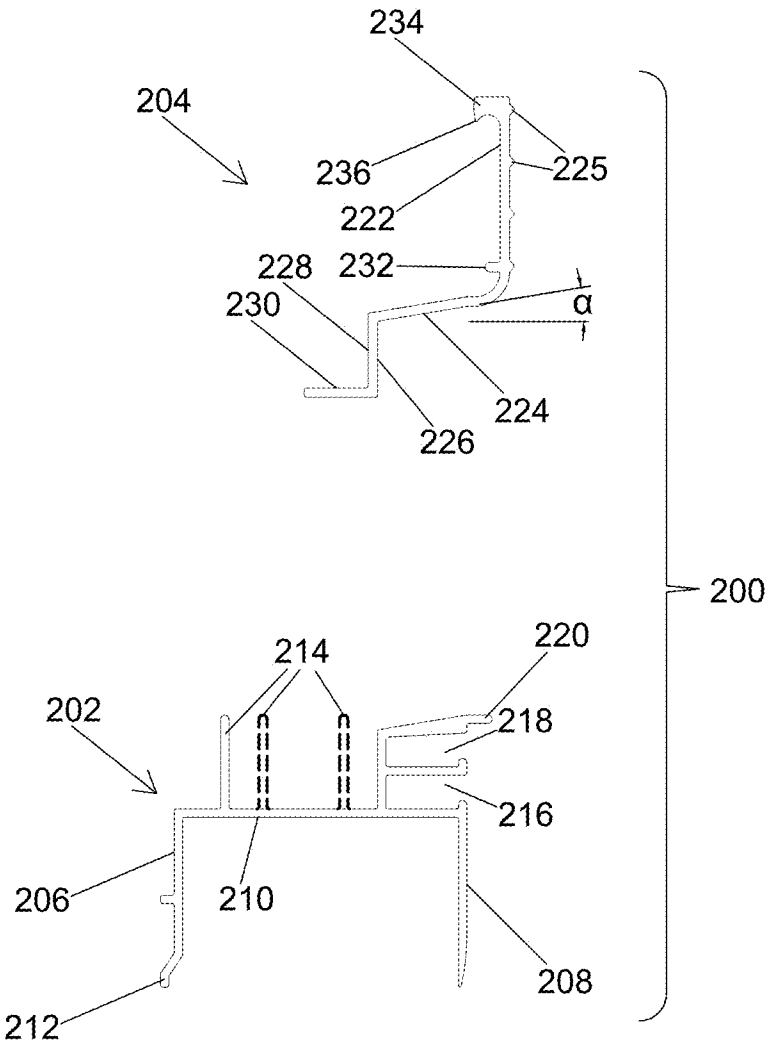
FIG. 34 is an exploded side elevation view of the coping arrangement shown in FIG. 33.
Figure 33:
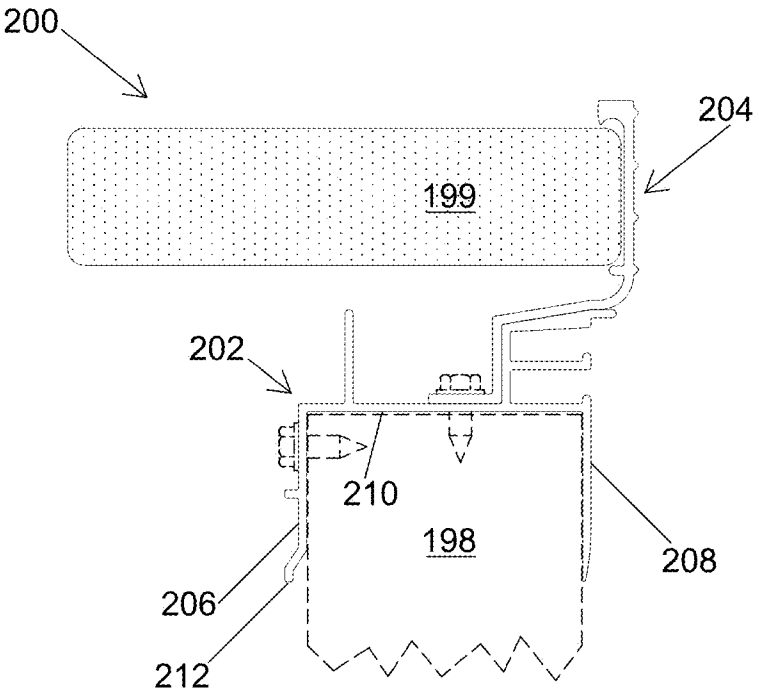
FIG. 33 is a side elevation view of a further coping arrangement having the top member shown in FIGS. 29 through 32 according to another aspect of the invention.

FIG. 33 is a side elevation view of a further coping arrangement 200 having top member 204 shown in FIGS. 29 through 32 according to another aspect of the invention. FIG. 34 is an exploded side elevation view of the coping arrangement 200 shown in FIG. 33. As shown in FIGS. 33 and 34, though shown in profile, coping arrangement 200 includes an elongated base member 202 and elongated top member 204 similar in design, construction, and function to elongated base members 52, 102, and 152 and elongated top members 54, 104, and 154 disclosed above. Specifically, base member 202 mounts to the top of pool panel 198 (shown in phantom in FIG. 33), for example, with mechanical fasteners, and top member 204 engages base member 202. As is typical of members 52, 102, 152, 54, 104, and 154, elongated members 202 and 204 may be elongated, arcuate or curved members conforming to the elongation and/or radius of pool panel 198. In one aspect, pool panel 198 and members 202 and 204 may be radiused, for example, concave or convex, or unradiused, for example, substantially straight or linearly elongated. In one aspect, the curvature or elongation of members 202 and 204 may vary, for example, consistent with the variation of the curvature of panel 198.

As shown in FIGS. 33 and 34, in this aspect, elongated base member 202 may have all the attributes, design, construction, and function of base member 52 disclosed in FIGS. 4 through 16. For example, base member 202 may be an extrusion of any one or more of the materials disclosed herein and have elongated opposing flanges 206 and 208 mounted to a main panel or plate 210 and opposing flanges 206 and 208 engage the top of sidewall 198 (shown in phantom in FIG. 33). The mounting of base member 202 to sidewall 198 may include the use of one or more mechanical fasteners (not shown), for example, screws inserted through flange 206, flange 208, and/or plate 210. Flange 206 may typically have at least one projection 212 and plate 210 may typically have one or more ribs 214, one or more cavities 216, 218, and at least one projection 220. In one aspect, base member 202 may be substantially identical to base member 52. Accordingly, in one aspect, the principal distinction between coping arrangement 50 shown in FIGS. 4 through 16 and coping arrangement 200 shown in FIGS. 33 and 34 is the shape of top member 204.

As shown in most clearly in FIG. 33, elongated top member 204, for example, a PVC plastic extrusion, is uniquely adapted to engage or accommodate a platform or decking 199 (shown in phantom), for example, lumber, pressure-treated lumber, or composite decking, and provide an aesthetically pleasing transition from the decking 199 to the pool sidewall 198. As shown in FIGS. 33 and 34, top member 204 may include an elongated side portion 222, an elongated transition portion 224, and an elongated mounting portion 226. Mounting portion 226 may typically include a vertical portion 228 and a horizontal portion 230 adapted to engage base member 202, for example, mount to plate 210 as shown.

As shown in FIG. 34, side portion 222 may be adapted to engage and/or receive decking 199. For example, side portion 222 may include a lower lip or projection 232 positioned to receive the bottom edge of decking 199 and an upper lip or projection 234 positioned to receive the top edge of decking 199. In one aspect, at least one of the lower lip 232 and the upper lip 234 may include one or more "teeth" or sharp projections 236 to enhance the engagement of top member 204 with decking 199. In one aspect, the exposed surface or fascia of side portion 222 may be provided with aesthetically appealing designs or illustrations, and/or with features that enhance the bathers engagement with the surface, for example, a plurality of projections or ridges 225 to assist bathers in exiting the pool.

Mounting portion 226 of top member 204 may comprise any suitable structure adapted to engage top member 204 with base member 202, for example, by welding, with an adhesive, and/or with mechanical fasteners. In the aspect shown in FIGS. 33 and 34, top member 204 is secured to base member 202 with a plurality of mechanical fasteners, for example, screws (not shown). In one aspect, top member 204 may be secured to base member 202 with a plurality self-drilling screws, for example, Teks® screws provided by Illinois Tool Works, or their equivalent. The horizontal portion 230 of mounting portion 226 may include pre-drilled holes to accommodate and locate the fasteners, or no holes may be provided and the self-drilling screws may also penetrate horizontal portion 230 while engaging base member 202 and/or sidewall 198.

Transition portion 224 of top member 204 may comprise any structure that connects side portion 222 to mounting portion 226, for example, with smooth radiused changes in geometry. In one aspect, transition portion 224 may be omitted and side portion 222 may mount directly to mounting portion 226. In the aspect of the invention shown in FIGS. 33 and 34, transition portion 224 comprises an angled section connecting the bottom of side portion 222 to the top of mounting portion 226. The angle of orientation, a, of the angled section of portion 224 may vary broadly, depending upon, for example, the geometry of the installation. For example, the angle of orientation, a, may vary from about 5 degrees to about 85 degrees, for instance, about 10-15 degrees, as shown.

As discussed above, base member 202 and top member 204 may be fabricated as extrusions, for example, base member 202 may comprise an extruded aluminum alloy and top member 204 may comprise an extruded PVC plastic. However, base member 202 and top member 204 may be fabricated from two or more piece parts and, for example, assembled with an adhesive, with welding, or with mechanical fasteners.

Figure 35:
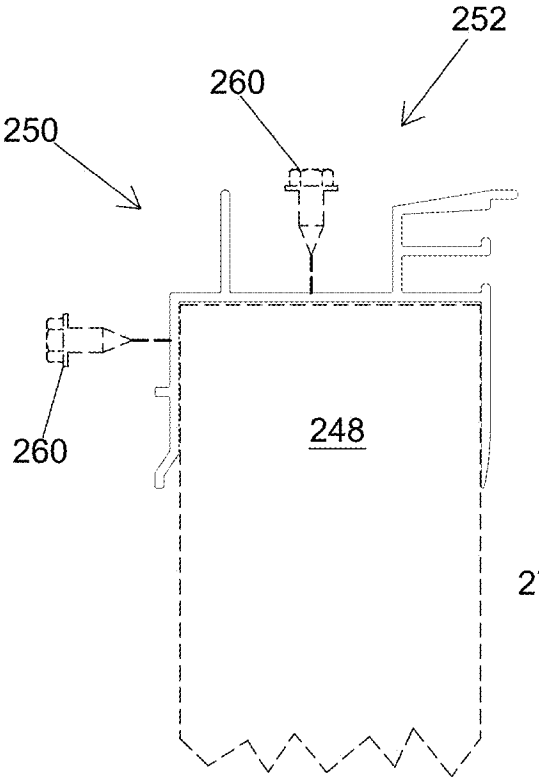

FIGS. 35 through 38 are partial cross-sectional views of an installation sequence according to an aspect of the invention. FIG. 35 is a cross-sectional elevation schematic view of a typical coping installation arrangement 250 of one base member 252, for example, comparable to base member 52, 102, 152, or 202 disclosed herein, to a pool panel 248, for example, an insulated pool panel provided by Radiant Pools. As shown, base member 252 and other base members 252 (not shown) are mounted to adjacent panels 248 (which, along with appropriate structural support, may define the support structure of the pool), may be secured to panels 248 with a plurality of screws 260, for example, a plurality of self-drilling Teks® screws. As shown, screws 260 may be installed in the top of the panel 248 and/or into the sides of panel 248.

Figure 36:
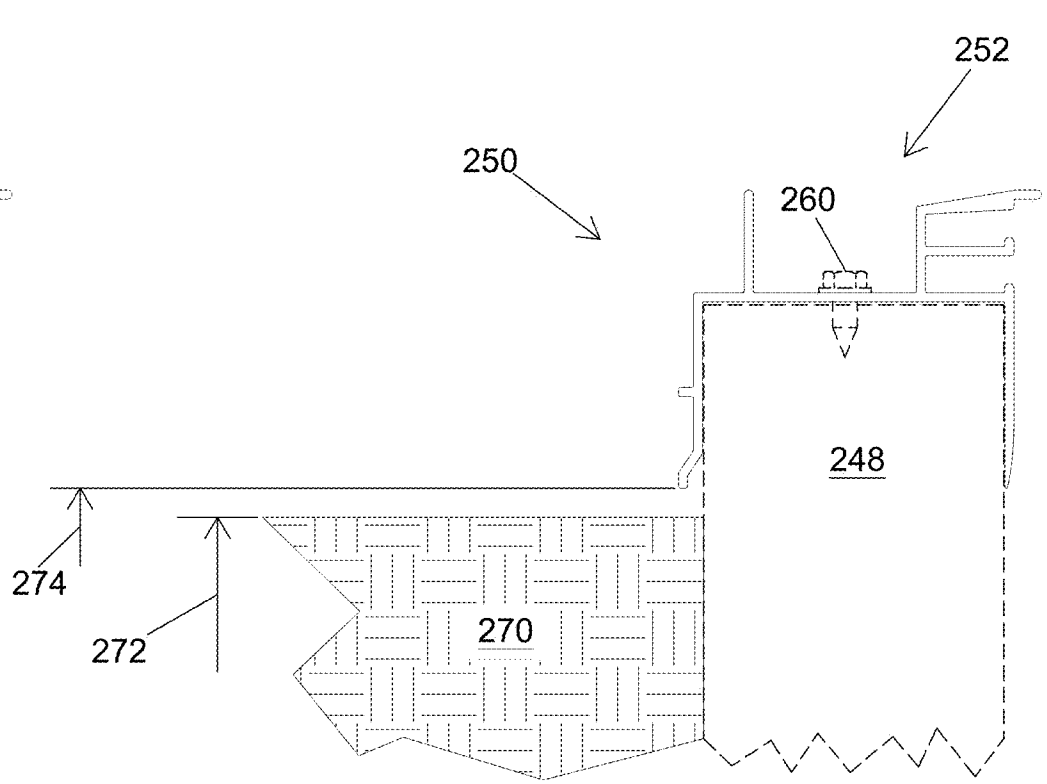
FIGS. 35 through 38 are partial cross sectional views of an installation sequence according to an aspect of the invention.

In one aspect, as shown in FIG. 36, with base members 252 secured to panels 248, the desired backfill 270, for example, sand, soil, stone, cement, concrete, or mixtures thereof, may be provided about the outside periphery of panels 248. As shown in FIG. 36, according to aspects of the invention, backfill 270 may typically be installed to a predetermined elevation 272 beneath the elevation 274 of the external lower extremity of base member 252. According to aspects of the invention, the limited, predetermined elevation 272 allows the installer access to base member 252 for installation of an appropriate top member (not shown).

Figure 38:
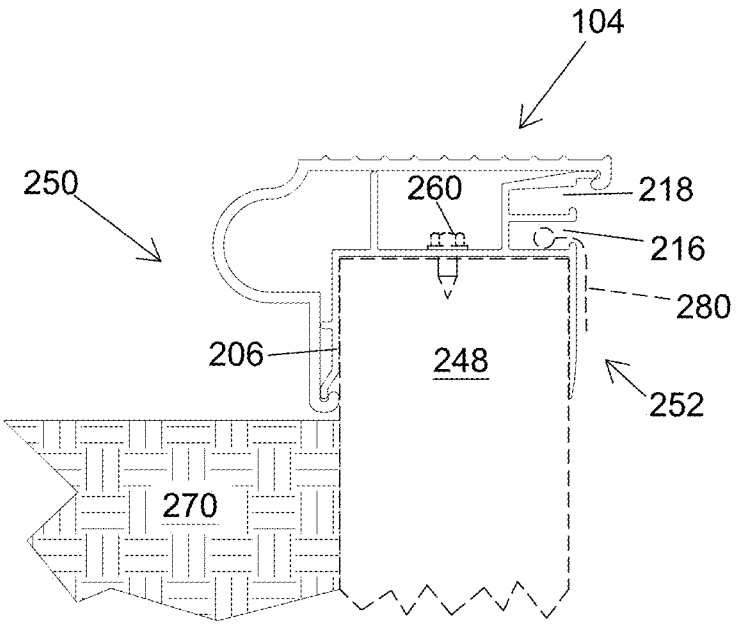
Figure 37:
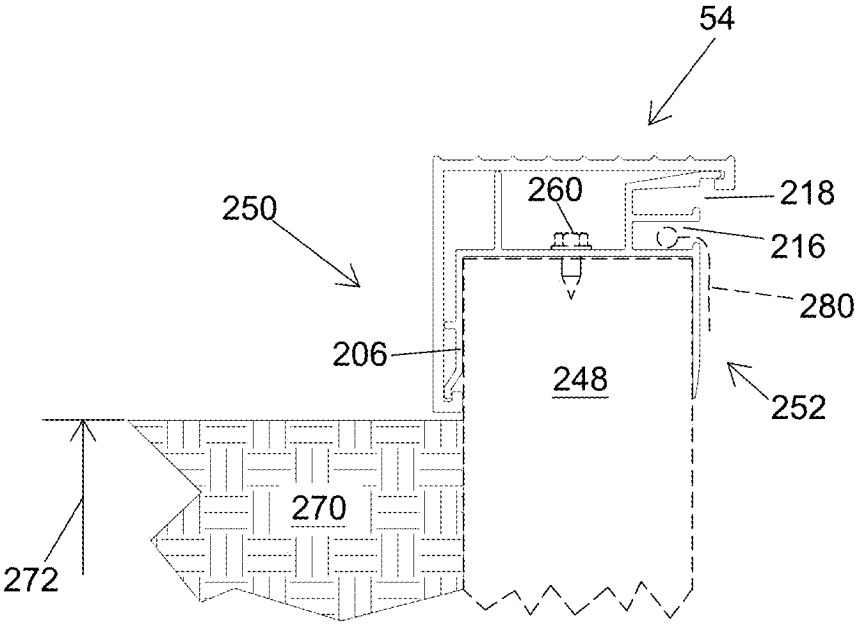

FIGS. 37 and 38 are schematic illustrations of further pool installation procedures initiated by the procedures illustrated in FIGS. 35 and 36. As shown in FIG. 37, with the access permitted by the limited elevation 272 of backfill 270, top member 54 (disclosed and discussed above) may be attached to base member 252 as disclosed herein. According to one aspect, with the attachment of top member 54 to base member 252, further backfill 270 may be provided and/or deck structure (not shown) may be installed, for example, to an elevation above the lower extremity of base member 252, to substantially complete the backfill/coping/sidewall installation. As shown in phantom in FIG. 37, prior to or after completion of the backfill and/or decking, a pool liner 280 may be installed to the internal surface of the pool panels 248, as is typical.

According to another aspect of the invention, as shown in FIG. 38, if desired, top member 54 may be removed from base member 252 and replaced by a similar top member 54, or, according to an aspect of the invention, a different top member 104 (as disclosed and discussed above) or any other top member disclosed herein. That is, according to aspects of the present invention, among other things, top members 54 may be replaced with other top members 104, 154, 204, and the like, to provide a different aesthetic appearance to the pool coping, with minimal time and effort expended, for example, by the pool owner or the pool installer.

FIGS. 37 and 38 also illustrate another advantage and/or capability of aspects of the invention. Specifically, in one aspect, the base member/top member coping construction disclosed herein may effectively isolate coping functions among coping members. For example, as shown in FIGS. 37 and 38, base member 252 (and any of the base members disclosed herein) provide the function of retaining liner 280 and the cover (not shown). As shown in FIGS. 37 and 38, base member 252 may receive and retain the liner 280 in cavity 216 and the cover (not shown) in cavity 218. In contrast, the top members 54 and 104 (any top member disclosed herein) may not influence, affect, and/or interfere with the reception and retaining of liner 280 and/or the cover (not shown). As will be discussed with respect to FIGS. 39 through 41, this separation of the liner/cover retention of base member 252 from top member 54, 104, or any top member disclosed herein, provides unique advantages for, among others, the pool owner and/or the pool installer, according to aspects of the invention.

Figure 40:
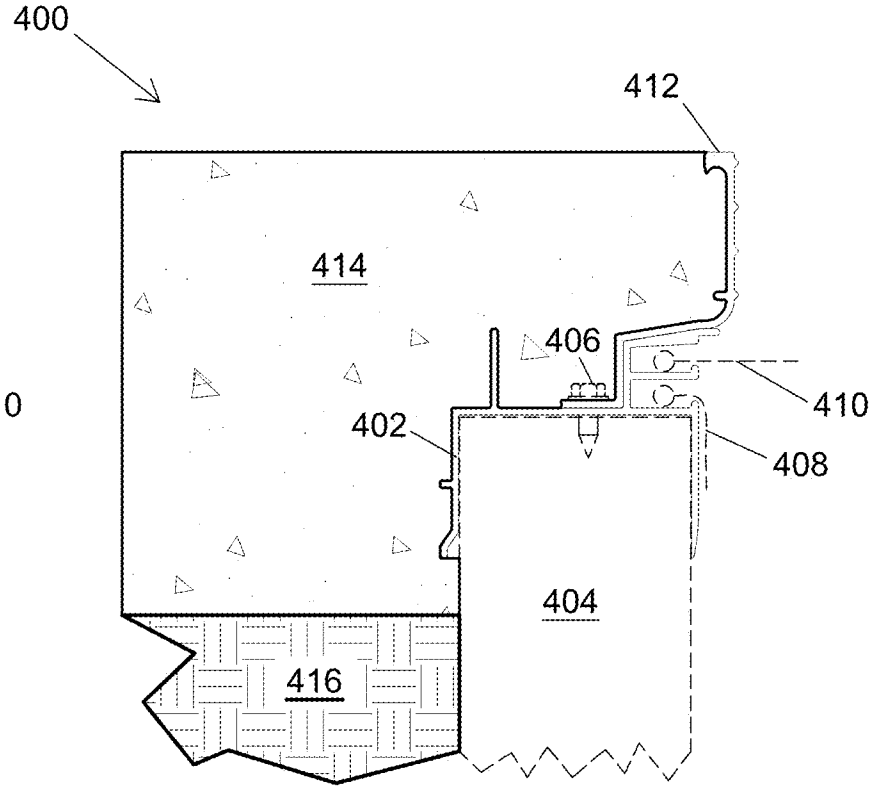
FIGS. 39 through 41 are partial cross sectional views, similar to FIGS. 35 through 38, of alternate installation options provided by aspects of the invention.
Figure 39:
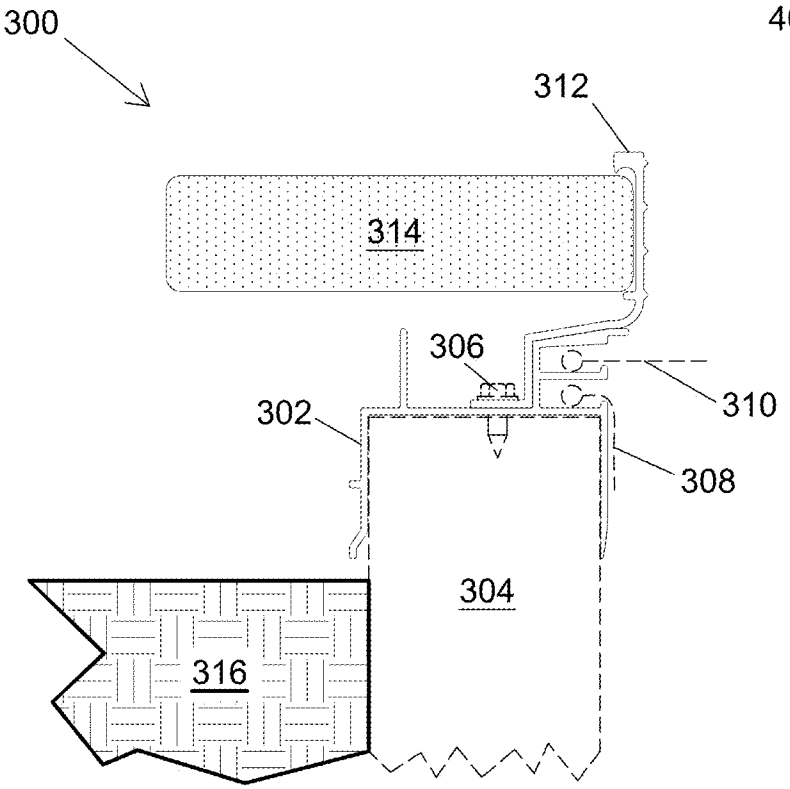
Figure 41:
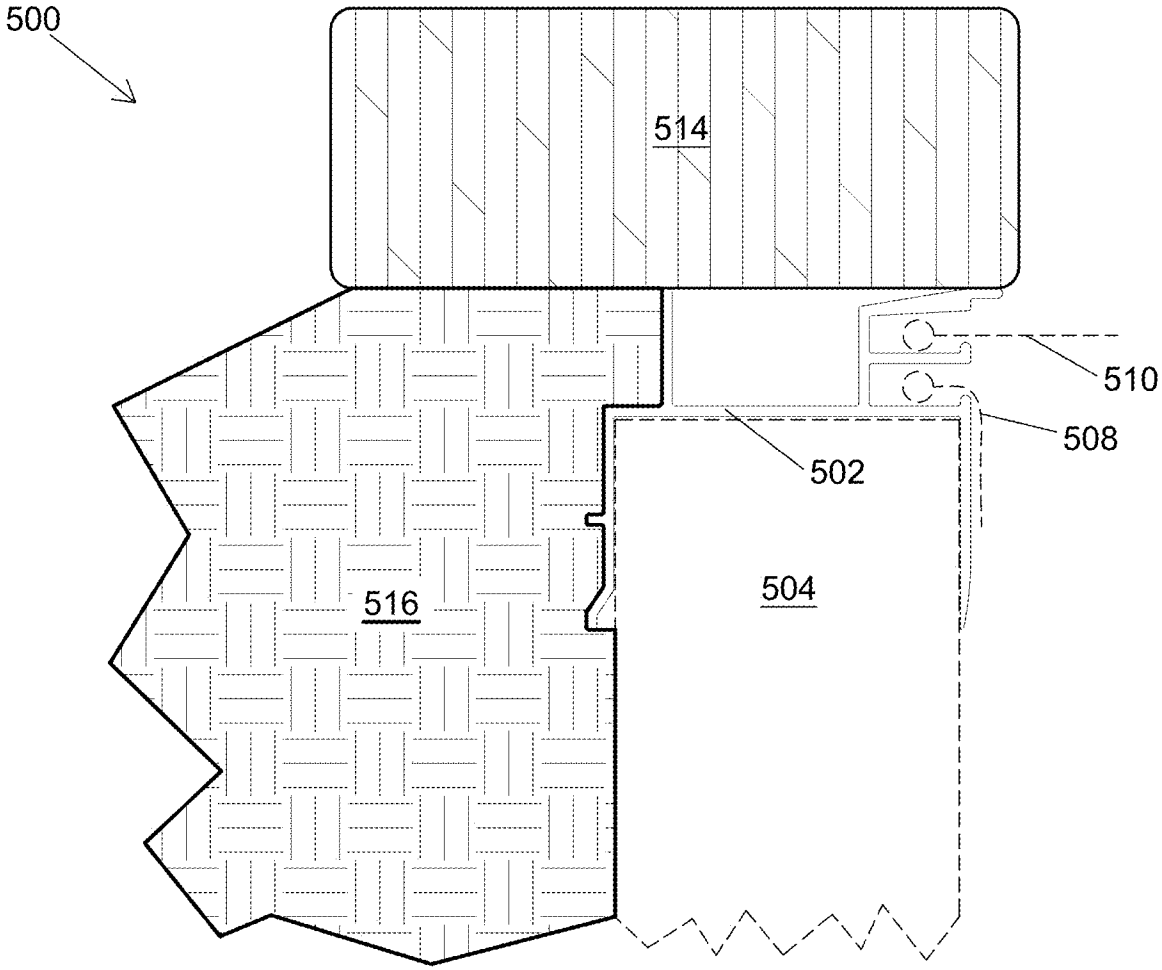

FIGS. 39 through 41 are partial cross sectional views, similar to FIGS. 35 through 38, of alternate installation arrangements provided by aspects of the invention. FIG. 39 is a cross-sectional view of one coping installation arrangement 300 according to one aspect of the invention. As shown in FIG. 39, arrangement 300 includes the mounting of a base member 302 to a pool wall 304, for example, by means of one or more fasteners 306. Base member 302 may be any one of the base members disclosed herein, for example, base member 204 shown in FIGS. 29 through 32.

As shown in FIG. 39, base member 302 receives and retains pool liner 308 (partially shown in phantom) and pool cover 310 (partially shown in phantom). As also shown in FIG. 39, a top member 312, which may be similar to top member 52 shown in FIGS. 11 through 14, may be mounted to base membered 302, for example, by mechanical fastener 306, and a deck, represented by a single board or panel 314, which typically may include a plurality of boards or panels, may be installed and engage top member 312, for example, as described with respect to FIG. 13. In the aspect shown in FIG. 39, at least some back fill 316 may be installed adjacent to pool wall 304.

As illustrated in FIG. 39, though the coping installation arrangement 300 includes a base member 302 and a top member 312, only base member 302 engages and retains liner 308 and/or cover 310. Therefore, according to aspects of the invention, top member 312 and any structure associated with top member 312, such as, decking 314, may be removed from or installed onto coping installation arrangement 300 without interfering with liner 308, cover 310, or the mounting of the liner 308 or the mounting of cover 310. This advantageous aspect of the invention becomes apparent with a comparison of the coping installation arrangement 250 shown in FIG. 38 with the coping installation arrangement 300 shown in FIG. 39.

As shown in FIG. 38, coping installation arrangement 250 includes base member 252 which retains liner 280 (shown in phantom) and a top member 104. According to an aspect of the invention, should it be desired that the top member 104 (or any top member disclosed herein) be removed (for example, by the pool owner and/or pool installer) and a different coping installation arrangement be installed, the top member 104 may be removed without affecting the installation of liner 280. Specifically, in one aspect of the invention, a coping installation arrangement 250 may be modified, changed, and/or effectively replaced without affecting or interfering with the mounting and/or presence of pool liner 280 (and the pool water liner 280 retains) and/or a pool cover (not shown).

For example, in one aspect, coping installation arrangement 250 shown in FIG. 38 may be replaced with coping installation arrangement 300 shown in FIG. 39 (or coping installation arrangement 400 shown in FIG. 40 or coping installation arrangement shown in FIG. 41) without affecting pool liner 280 and the water liner 280 retains. For instance, in one aspect, to change the coping arrangement from the coping installation arrangement 250 shown in FIG. 38, the installer need only remove top member 104 shown in FIG. 38, for example, by disengaging top member 104 from base member 252 as disclosed herein, and replacing top member 104 with top member 312 shown in FIG. 39, for example, by mounting top member 312 to base member 302 with mechanical fasteners 306, as disclosed herein. As shown in FIG. 39, upon replacement of top member 104 with top member 312, decking 314 may be installed. According to aspects of the invention, neither the removal of top member 104 from base member 252 (in FIG. 38), the installation of top member 312 on base member 302 (in FIG. 39), or the installation of decking 314 (in FIG. 39) affects or interferes with the presence or installation of liner 280 (in FIG. 39), liner 308 (in FIG. 40), which may be the same liner, cover 310, or the pool water the liners retain.

As will be readily apparent to those of skill in the art, the opportunity to modify, change, and/or replace a pool coping installation arrangement without removing pool liner 280 or 308, according to aspects of the invention, and thus, typically, not requiring the emptying of the pool of water to remove the pool liner, can provide a marked advantage over prior art methods and arrangements. For example, aspects of the invention can reduce the time for making any coping installation changes and can increase the convenience of making such changes compared to prior art methods that, typically, require emptying the pool and at least detachment, if not removal, of the pool liner prior to any modification of any coping installation arrangement.

FIGS. 40 and 41 illustrate two further coping installation arrangements that can be provided, for example, as modifications of coping installation arrangement 250 shown in FIG. 39. Again, the modifications shown in FIGS. 40 and 41 may have no effect or impact upon a pool liner (or a pool cover) as disclosed herein.

FIG. 40 is a cross sectional view of another coping installation arrangement 400 according to one aspect of the invention. As shown in FIG. 40, arrangement 400 includes the mounting of a base member 402 to a pool wall 404, for example, by means of one of more fasteners 406. Base member 402 may be any of the base members disclosed herein, for example, base member 204 shown in FIGS. 29 through 32. As shown, base member 402 receives and retains pool liner 408 (partially shown in phantom) and pool cover 410 (partially shown in phantom). As also shown in FIG. 40, a top member 412, which may be similar to top member 52 shown in FIGS. 11 through 14, may be mounted to base membered 402, for example, by mechanical fastener 406, and a concrete deck 414, may be installed, for example, poured, and engage top member 412. In one aspect, top member 412 may provide at least a partial "form" into which fluid concrete may be poured in forming deck 414. In the aspect shown in FIG. 40, at least some back fill 416 may be installed adjacent to pool wall 404, for example, before pouring concrete deck 414.

In one aspect, coping installation arrangement 250 shown in FIG. 38 or coping installation arrangement 300 shown in FIG. 39 may be replaced with coping installation arrangement 400 shown in FIG. 39 without affecting a pool liner and the water the liner retains. For instance, in one aspect, to change the coping arrangement from the coping installation arrangement 250 shown in FIG. 38, the installer need only remove top member 104 shown in FIG. 38, for example, by disengaging top member 104 from base member 252 as disclosed herein, and replacing top member 104 with top member 412 shown in FIG. 40, for example, by mounting top member 412 to base member 402 with mechanical fasteners 306, as disclosed herein. As shown in FIG. 40, upon replacement of top member 104 with top member 412, concrete deck 414 may be installed. According to aspects of the invention, neither the removal of top member 104 from base member 252 (in FIG. 38), the installation of top member 412 on base member 402 (in FIG. 40), or the installation of concrete decking 414 (in FIG. 40) affects or interferes with the presence or installation of liner 280 (in FIG. 39), liner 408 (in FIG. 41), which may be the same liner, cover 410, or the pool water the liners retain.

FIG. 41 is a cross sectional view of another coping installation arrangement 500 according to one aspect of the invention. As shown in FIG. 41, arrangement 500 includes the mounting of a base member 502 to a pool wall 504, for example, by means of one of more fasteners (not shown). Base member 502 may be any one of the base members disclosed herein, for example, base member 204 shown in FIGS. 29 through 32. As shown, base member 502 receives and retains pool liner 508 (partially shown in phantom) and pool cover 510 (partially shown in phantom). As also shown in FIG. 41, in this aspect of the invention, no top member, for example, no top member such as top member 412 shown in FIG. 40, may be used in coping installation arrangement 500. In this aspect of the invention, a deck 514, for example, a deck made from pavers (such as "inground pavers"), a deck made from wood or composite boards, or a deck made from concrete, among other decking materials, may be used for deck 514. In the aspect shown in FIG. 41, at least some back fill 516 may be installed adjacent to pool wall 504, for example, before installing deck 514.

In one aspect, coping installation arrangement 250 shown in FIG. 38 or coping installation arrangement 300 shown in FIG. 39 or coping installation arrangement 400 shown in FIG. 40 may be replaced with coping installation arrangement 500 shown in FIG. 41 without affecting a pool liner and the water the liner retains. For instance, in one aspect, to change the coping arrangement from the coping installation arrangement 250 shown in FIG. 38, the installer need only remove top member 104 shown in FIG. 38, for example, by disengaging top member 104 from base member 252 as disclosed herein. However, in the aspect shown in FIG. 41, no top member need be used. As shown in FIG. 41, upon removal of top member 104, deck 514 may be installed, for example, laid or otherwise mounted directly on top of base member 252 (in FIG. 38) or base member 502 (in FIG. 41). According to aspects of the invention, neither the removal of top member 104 from base member 252 (in FIG. 38) or the installation of decking 514 (in FIG. 41) may affect or interfere with the presence or installation of liner 280 (in FIG. 39) or liner 508 (in FIG. 41), which may be the same liner, cover 510, or the pool water the liners retain.

Though aspects of the present invention have been described with respect to the replacement of coping installation arrangement 250 shown in FIG. 38 with coping installation arrangements shown in FIGS. 39, 40, and 41, it is envisioned that any of the coping arrangements disclosed herein may be modified, changed, or replaced with any other coping installation arrangement while still providing the benefits and advantages described herein. For example, the coping arrangement 50 disclosed in FIGS. 15 and 16; coping arrangement 100 disclosed in FIGS. 21 and 22; coping arrangement 150 disclosed in FIGS. 27 and 28; or coping arrangement 200 disclosed in FIGS. 33 and 34, among others, may be modified, changed, or replaced with any one of coping installation arrangements shown in FIGS. 39, 40, and 41, and provide similar benefits and advantages, for example, not affecting a pool liner or a pool cover.

It is believed that it will be clear from the above disclosure that the present invention, in its several embodiments and many aspects, provides unique opportunities to facilitate pool installation and the modification of pool appearance. According to aspects of the invention, coping arrangements, methods of installing coping, and coping members are provided that facilitate the installation of and enhance the appearance of pool copings, and swimming pools in general. Though it is envisioned that aspects of the invention are uniquely adapted to swimming pools, including inground, partially inground, and above ground pools, it is also recognized that aspects of the invention may be use in any application where copings or coping like structures are advantageous, including for adorning or protecting residential or commercial water features (for example, ornamental ponds and streams) and commercial or industrial vessels or tanks, among other structures. Other applications of aspects of he invention will be apparent to those skilled in the art.

The terminology used herein is provided for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed.

The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The embodiments were chosen and described in order to best explain the principles of the disclosure and the practical application, and to enable others of ordinary skill in the art to understand the disclosure for various embodiments with various modifications as are suited to the particular use contemplated.

The invention claimed is:

1. A swimming pool coping arrangement comprising:

an elongated base member shaped and adapted to be received by a wall of a swimming pool and having an elongated recess adapted to receive a liner of the swimming pool; and an elongated top member adapted to be mounted to the elongated base member, the elongated top member having an elongated side portion having a first side having an exposed contour and a second side, opposite the first side, adapted to receive a decking member having a rectangular cross section, and wherein the elongated top member comprises an elongated mounting portion adapted to engage the elongated base member and an elongated transition portion between the elongated side portion and the elongated mounting portion;

wherein, when mounted to the elongated base member, the exposed contour of the top member comprises an exposed contour above the elongated liner recess of the base member.

2. The coping arrangement as recited in claim 1, wherein the decking member having the rectangular cross section received by the second side of the elongated side portion comprises one of a lumber member, a pressure treated lumber member, and a composite decking member.

3. The coping arrangement as recited in claim 1, wherein the swimming pool comprises an above-ground swimming pool or a partially above-ground swimming pool.

4. The coping arrangement as recited in claim 1, wherein the exposed contour of the first side of the side portion of the elongated top member is positioned internal of an inner surface of the wall of the swimming pool.

5. The coping arrangement as recited in claim 1, wherein the second side of the elongated top member, opposite the first side, adapted to receive the decking member comprises a first projection positioned to receive the decking member.

6. The coping arrangement as recited in claim 5, wherein the second side of the elongated top member further comprises a second projection, above the first projection, positioned to receive the decking member.

7. The coping arrangement as recited in claim 6, wherein at least one of the first projection and the second projection comprises one or more teeth adapted to enhance engagement with the decking member.

8. The coping arrangement as recited in claim 1, wherein the exposed contour of the first side of the elongated top member comprises a fascia having a design or illustration.

9. The coping arrangement as recited in claim 1, wherein the exposed contour of the first side of the elongated top member comprises a plurality of projections adapted to assist bathers in exiting the swimming pool.

10. The coping arrangement as recited in claim 1, wherein the elongated top member comprises a first elongated top member having a first exposed contour, and wherein the coping arrangement further comprises a second elongated top member having a second exposed contour, different from the first exposed contour.

11. The coping arrangement as recited in claim 10, wherein the first exposed contour comprises a first axial cross section, and wherein the second exposed contour comprises a second axial cross section, different from the first axial cross section.

12. The coping arrangement as recited in claim 1, wherein the elongated base member is shaped and adapted to be received by an insulated wall panel.

13. The coping arrangement as recited in claim 1, wherein the elongated base member is further adapted to retain a pool cover.

14. The coping arrangement as recited in claim 1, wherein the elongated base member shaped and adapted to be received by the wall of the swimming pool comprises an elongated base member shaped and adapted to be received by a top of a pool wall panel.

15. The coping arrangement as recited in claim 14, wherein the elongated base member is adapted to engage sidewalls of the swimming pool wall panel.

16. The coping arrangement as recited in claim 1, wherein the elongated base member comprises a radiused elongated base member and the elongated top member comprises a radiused elongated top member.

17. The coping arrangement as recited in claim 16, wherein the radiused elongated base member and the radiused elongated top member are one of convex radiused and concave radiused.

18. The coping arrangement as recited in claim 1, wherein, when received by the second side of the elongated side portion, the decking member is positioned over the wall of the swimming pool.

19. The coping arrangement as recited in claim 1, wherein the arrangement further comprises a plurality of fasteners adapted to retain the elongated mounting portion on the elongated base member.

20. The coping arrangement as recited in claim 1, wherein the elongated transition portion comprise an angle section having an angle $\alpha$.

* * * * *